US010895139B2

(12) United States Patent
Sizemore et al.

(10) Patent No.: US 10,895,139 B2
(45) Date of Patent: Jan. 19, 2021

(54) FRAC MANIFOLD ISOLATION TOOL

(71) Applicant: OIL STATES ENERGY SERVICES, L.L.C., Houston, TX (US)

(72) Inventors: Richard Brian Sizemore, White Oak, TX (US); Bob McGuire, Meridian, OK (US); Danny L. Artherholt, Asher, OK (US); Nicholas Langston, Yukon, OK (US); Blake Mullins, Edmond, OK (US); Mickey Claxton, Oklahoma City, OK (US)

(73) Assignee: OIL STATES ENERGY SERVICES, LLC, Houston, TX (US)

( * ) Notice: Subject to any disclaimer, the term of this patent is extended or adjusted under 35 U.S.C. 154(b) by 0 days.

(21) Appl. No.: 16/850,414

(22) Filed: Apr. 16, 2020

(65) Prior Publication Data

US 2020/0340343 A1 Oct. 29, 2020

Related U.S. Application Data

(60) Provisional application No. 62/838,026, filed on Apr. 24, 2019.

(51) Int. Cl.
*E21B 43/26* (2006.01)

(52) U.S. Cl.
CPC ..... *E21B 43/2607* (2020.05)

(58) Field of Classification Search
CPC ..... E21B 43/2607; E21B 33/03; E21B 34/02; E21B 34/14; E21B 34/066; F16K 31/122; F16K 11/20; F16K 11/22; F16K 3/18; F16K 3/188
USPC ..... 251/167, 190, 193, 195, 197, 198, 199, 251/200
See application file for complete search history.

(56) References Cited

U.S. PATENT DOCUMENTS

| | | | | |
|---|---|---|---|---|
| 2,927,643 | A | 3/1960 | Dellinger | |
| 3,223,112 | A * | 12/1965 | Ashbrook | F16K 31/122 137/458 |
| 3,830,304 | A | 8/1974 | Cummins | |
| 3,924,678 | A | 12/1975 | Ahlstone | |
| 4,076,079 | A | 2/1978 | Herricks et al. | |
| 4,241,786 | A | 12/1980 | Bullen | |
| 4,477,052 | A * | 10/1984 | Knoblauch | F16K 3/0254 251/57 |
| 4,632,183 | A | 12/1986 | McLeod | |
| 4,867,243 | A | 9/1989 | Garner et al. | |
| 5,069,288 | A | 12/1991 | Sinigeetham | |

(Continued)

FOREIGN PATENT DOCUMENTS

CA 2195118 7/1998

OTHER PUBLICATIONS

Patent Cooperation Treaty; PCT/US2020/028452; International Search Report and Written Opinion; dated Jul. 17, 2020.

*Primary Examiner* — Michael R Reid
(74) *Attorney, Agent, or Firm* — Morgan, Lewis & Bockius LLP

(57) ABSTRACT

A frac manifold isolation tool configured to connect to a zipper spool, and comprising a mandrel that is axially movable and a hydraulic setting tool configured to move the mandrel from an open position, in which fracturing fluid is allowed to flow from a zipper spool to a connected frac tree, to a closed position, in which the mandrel and its associated cup tool prevent fracturing fluid from flowing to the connected frac tree.

13 Claims, 21 Drawing Sheets

(56) References Cited

U.S. PATENT DOCUMENTS

| | | | | |
|---|---|---|---|---|
| 5,080,174 | A | 1/1992 | Hynes | |
| 5,145,006 | A | 9/1992 | June | |
| 5,247,997 | A | 9/1993 | Puccio | |
| 5,332,044 | A | 7/1994 | Dallas et al. | |
| 5,372,202 | A | 12/1994 | Dallas | |
| 5,411,081 | A | 5/1995 | Moore et al. | |
| 5,540,282 | A | 7/1996 | Dallas | |
| 5,785,121 | A | 7/1998 | Dallas | |
| 5,819,851 | A | 10/1998 | Dallas | |
| 5,927,403 | A | 7/1999 | Dallas | |
| 6,009,941 | A | 1/2000 | Haynes | |
| 6,019,175 | A | 2/2000 | Haynes | |
| 6,179,053 | B1 | 1/2001 | Dallas | |
| 6,220,363 | B1 | 4/2001 | Dallas | |
| 6,289,993 | B1 | 9/2001 | Dallas | |
| 2006/0185841 | A1 | 8/2006 | Swagerty et al. | |
| 2009/0090515 | A1 | 4/2009 | Chan et al. | |
| 2010/0051261 | A1 | 3/2010 | Koleilat et al. | |
| 2011/0108275 | A1 | 5/2011 | Borak et al. | |
| 2014/0311753 | A1 | 12/2014 | Pitcher et al. | |
| 2017/0370172 | A1* | 12/2017 | Tran | F04B 47/00 |
| 2018/0223621 | A1* | 8/2018 | McGuire | E21B 19/10 |
| 2018/0347286 | A1* | 12/2018 | Scott | E21B 17/05 |
| 2020/0032608 | A1 | 1/2020 | Christoperson et al. | |
| 2020/0032609 | A1 | 1/2020 | Guidry | |

* cited by examiner

FRAC MANIFOLD ISOLATION TOOL

TECHNICAL FIELD

The present disclosure relates generally to oil or gas wellbore equipment, and, more particularly, to a frac manifold.

BACKGROUND

Frac manifolds, also referred to herein as zipper manifolds, are designed to allow hydraulic fracturing operations on multiple wells using a single frac pump output source. Frac manifolds are positioned between the frac pump output and frac trees of individual wells. A frac manifold system receives fracturing fluid from the pump output and directs it to one of many frac trees. Fracturing fluid flow is controlled by operating valves to isolate output to a single tree for fracking operations.

Frac zipper manifolds may be rigged up to frac trees before frac equipment arrives at the well site. Once onsite, the frac equipment need only be connected to the input of the frac manifold. Because individual frac trees do not need to be rigged up and down for each fracking stage and because the same frac equipment can be used for fracking operations on multiple wells, zipper manifolds reduce downtime for fracking operations while also increasing safety and productivity. Another benefit includes reducing equipment clutter at a well site.

Despite their benefits, further efficiencies and cost savings for zipper manifolds may be gained through improved designs. In particular, the valves that have traditionally been used to control the flow of fracturing fluid to individual trees are expensive and greatly increase the cost of using a zipper manifold. With multiple valves required for each frac tree, when a zipper manifold is arranged to connect to several adjacent wells, the cost of the valves can easily be several hundred thousand dollars. Accordingly, what is needed is an apparatus, system, or method that addresses one or more of the foregoing issues related to frac zipper manifolds, among one or more other issues.

SUMMARY OF THE INVENTION

The frac manifold isolation tool uses one or more mandrels that may be hydraulically positioned to control frac fluid flow to one or more outputs of the manifold. When the mandrel is in the open position, frac fluid is able to flow to a bridge that is connected to a frac tree or wellhead, and the connected well can be fracked. When in the closed position, the mandrel stops flow to the bridge. With this design, the mandrel can serve to replace or reduce the number of valves that would otherwise control fluid in the manifold, thus making the use of a frac manifold much less expensive and more efficient.

BRIEF DESCRIPTION OF THE DRAWINGS

Various embodiments of the present disclosure will be understood more fully from the detailed description given below and from the accompanying drawings of various embodiments of the disclosure. In the drawings, like reference numbers may indicate identical or functionally similar elements.

DETAILED DESCRIPTION

Figure 1:
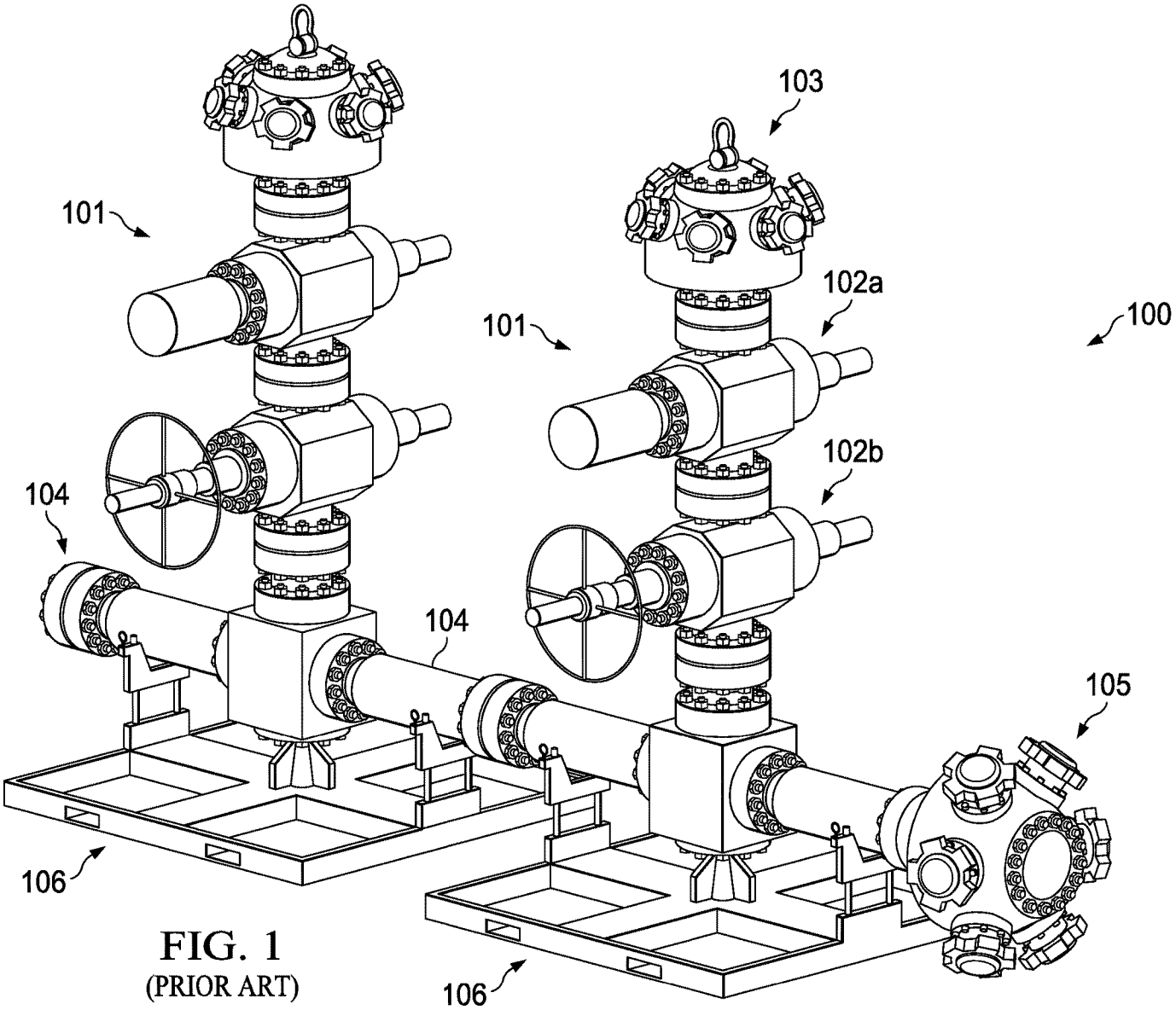
FIG. 1 (PRIOR ART)
FIG. 1 illustrates a zipper manifold as known in the prior art.

FIG. 1 illustrates an example of a prior art zipper manifold 100. The manifold may be positioned vertically, as shown in FIG. 1, or it may be positioned horizontally. The frac manifold 100 can include two or more well configuration units 101. Each well configuration unit 101 includes one or more valves 102 and a bridge connector header 103, and the well configuration units 101 may be collectively or individually (as shown) positioned on skids 106. Each bridge connector header 103 connects to a frac tree. As shown in FIG. 1, each well configuration unit 101 typically includes a hydraulically actuated valve 102*a* and a manually actuated valve 102*b*. The well configuration units 101 of the zipper manifold 100 are connected together by zipper spools 104, and the final zipper spool 104 may be capped off or connected to other well configurations 101 as needed. The zipper manifold 100 connects to the output of the frac pump at the frac supply header 105.

The bridge connector head 103 connects to the frac head of a frac tree. In operation, the valves 102 of one well configuration unit 101 are opened to allow fluid flow to the corresponding frac tree through its bridge connector 103 while the valves 102 of other well configuration units 101 in the zipper manifold 100 are closed. The valves 102 may be closed and opened to control the flow to different well configuration units 101 of the zipper manifold 100.

Figure 2:
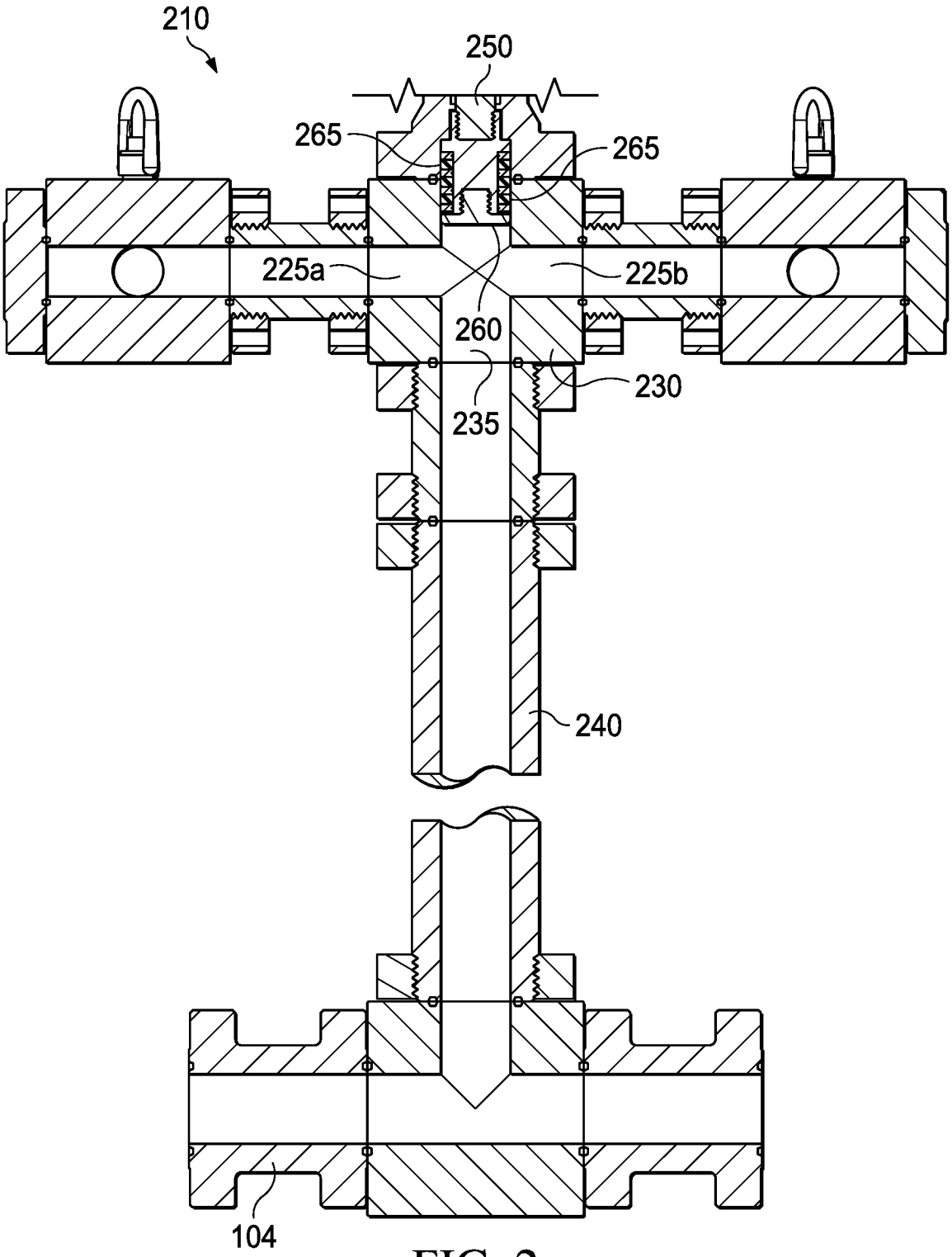
FIG. 2 illustrates an improved zipper manifold with a mandrel in the open position.
Figure 4:
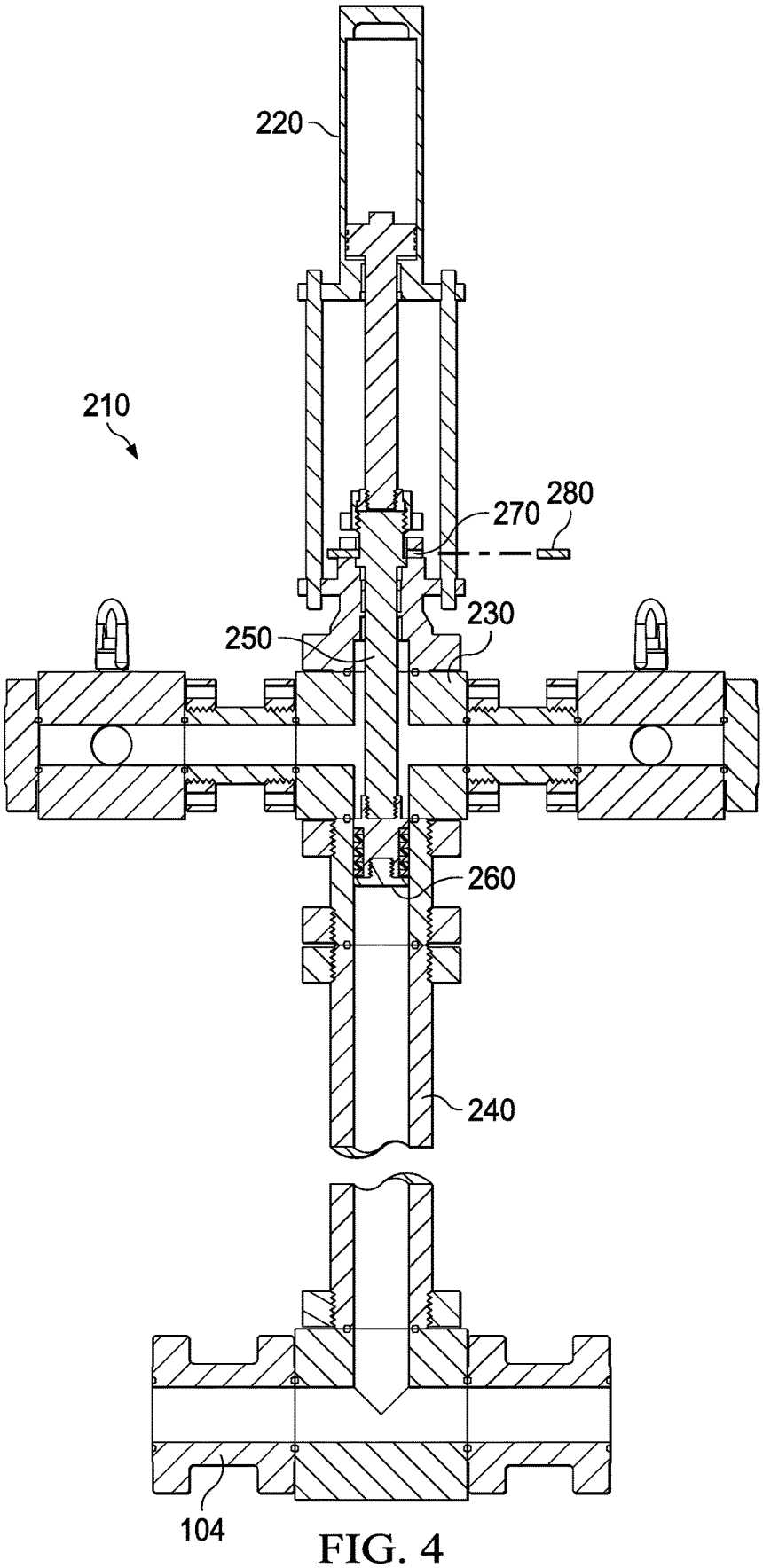
FIG. 4 illustrates an improved zipper manifold with a hydraulic setting cylinder.

FIG. 2 illustrates an exemplary embodiment of an improved well configuration unit 210. Improved well configuration unit 210 includes a hydraulic setting cylinder 220 (as shown in FIG. 4) connected to a mandrel 250. The bridge connector header 230, which connects to a frac tree, comprises a horizontal throughbore 225, as well as an axial throughbore 235 which forms a "T" junction by connecting to a lower bore, such as that shown within lower spool 240. It is not necessary that bridge connector header 230 include two throughbores. For example, bridge connector header 230 may comprise only a portion 225*a* of bore 225, and not portion 225*b*, or vice versa All that is required is a throughbore 235 to provide an inlet allowing fluid to flow into bridge connector header 230 and a second bore, such as 225*a* or 225*b*, to provide an outlet for fluid to flow out of bridge connector 230.

The hydraulic setting cylinder 220 actuates a mandrel 250 that moves within throughbore 235 and axially in line with the lower bore, e.g., lower spool 240. In the embodiment shown in FIG. 2, as described in more detail below, the hydraulic setting cylinder 220 and mandrel 250 are used in place of valves in the well configuration unit 210. In another embodiment, valves (whether manually or hydraulically actuated) may be used in conjunction with the hydraulic setting cylinder 220 and mandrel 250 in a well configuration unit 210 to control fluid flow.

Two or more well configuration units 210 are used in a zipper manifold to provide connectivity and fluid control to multiple frac trees and wells. Improved well configuration units 210 are fluidly connected through zipper spools 104 along the zipper manifold. A frac supply header 105 (similar to that shown in FIG. 1) provides fluid connectivity from the frac pump to the zipper manifold and zipper spools 104.

The hydraulic setting cylinder 220 moves the mandrel 250 into two primary positions. When the well configuration unit 210 is in the open position, which is shown in FIG. 2, the cup 260 of the mandrel 250 sits above bridge connector header 230, which allows fluid to flow from the zipper spool 104, through the lower spool 240, and through the "T" junction of the bridge connector header 230 to the connected bridge and frac tree. The mandrel 250 is solid at the cup 260 such that fluid does not flow through the mandrel 250. The cup 260 includes one or more seals 265, such as o-rings, that are able to form a seal against an inner spool above the "T" junction of the bridge connector header 230 and prevent pressure leaks and fluid flow around the cup 260 and to the hydraulic setting cylinder 220.

Figure 3:
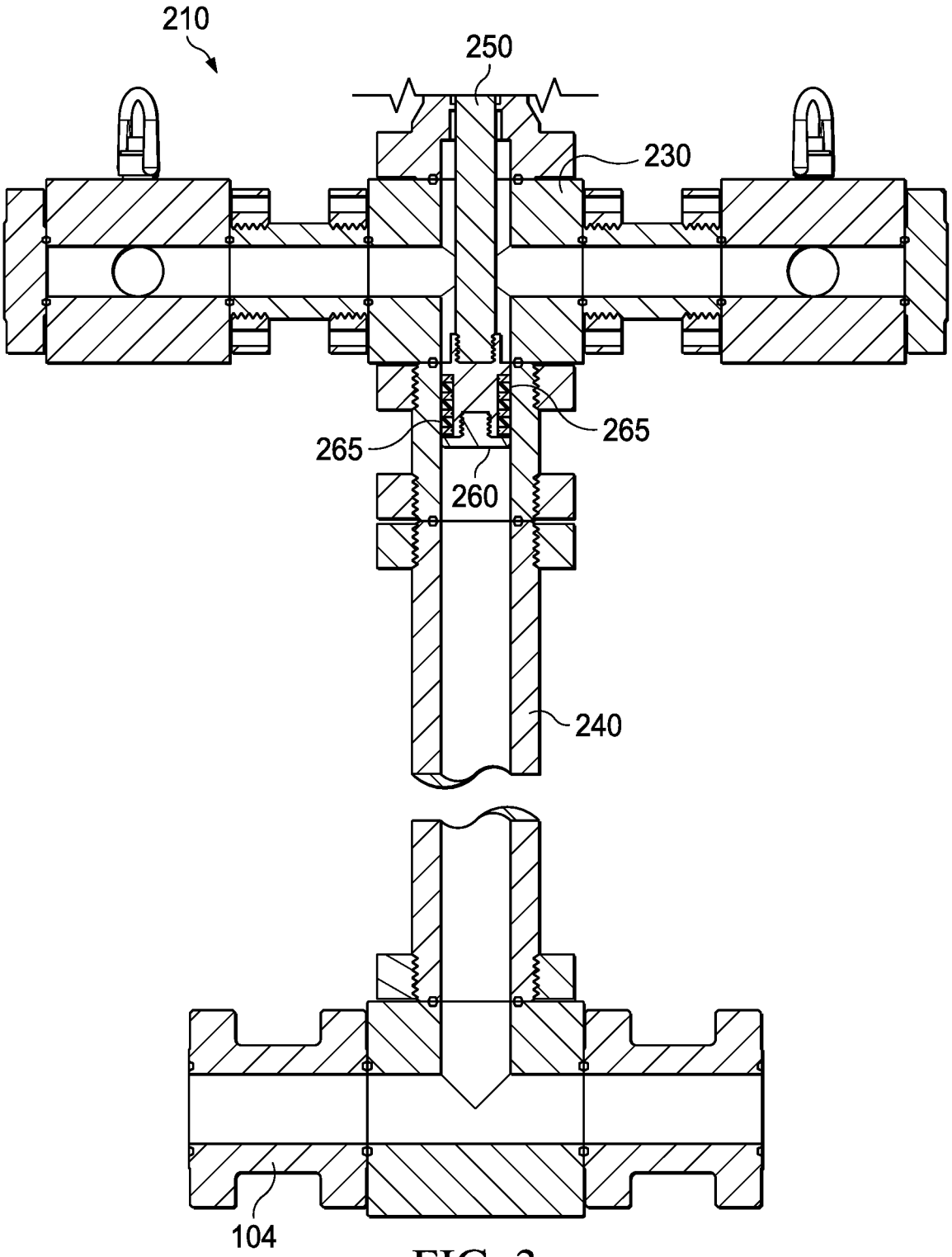
FIG. 3 illustrates an improved zipper manifold with a mandrel in the closed position.

In the closed position, which is shown in FIG. 3, the hydraulic setting cylinder 220 may move the mandrel 250 through the "T" junction of the bridge connector header 230, such that the cup 260 of the mandrel 250 will seat at a location below the "T" junction. As shown in FIG. 3, the cup 260 may optionally seal within lower spool 240, where seals 265 form a seal against the lower spool's 240 inner surface, which is preferably corrosion resistant. Alternatively, some or all of cup 260 may form a seal with the inner surface of bridge connector header 230, as long as the seal is formed below the "T" junction. When the mandrel 250 is in the closed position and a seal has been formed at a location below the junction of bridge connector header 230, fluid cannot flow past the cup 260 to the bridge connection header 230.

In an embodiment, which is shown in FIGS. 2 and 3, the inner diameter of the lower spool 240 and lower portion of bridge connector 230 is consistent, and the mandrel 250 is stroked to a location far enough down below the "T" junction of bridge connector 230 to allow mandrel cup 260 to seal. The mandrel cup seals 265 may form a seal with the inner surface of the lower spool 240 and/or the inner surface of bridge connector 230 when the mandrel cup 260 is axially compressed and the seals 265 extrude radially outward. The mandrel cup 260 will axially compress when the pressure below the mandrel cup 260 sufficiently exceeds the pressure above it, or in other words, when the pressure differential exceeds a particular threshold. The mandrel 250 is preferably moved from one position to another only when a seal has not been formed to avoid damaging the sealing elements. Thus, before the mandrel 260 is moved, the pressure above and below the mandrel cup 260 may be equalized, which will decompress the mandrel cup 260 and disengage the seals 265 from the inner surface of the spool.

In an embodiment, the mandrel cup 260 may be actuated to seat at or near an inner shoulder on the inner surface of the lower spool 240. In an embodiment, the inner shoulder serves as a physical stop for the actuation of the hydraulic setting cylinder 220, and the inner shoulder itself may be used as a stop against which to compress the mandrel cup 260, such that it forms a seal with the inner surface of the lower spool 240.

In an embodiment, the mandrel 250 may include one or more locking mechanisms. FIG. 4 illustrates an example of a hydraulic setting cylinder 220 that is connected on top of the bridge connection header 230. The hydraulic setting cylinder 220 includes a mandrel lock 270. The mandrel lock 270 accommodates a lock pin 280 that may be actuated by a second hydraulic cylinder (not shown). After the mandrel 250 has been stroked down to allow mandrel cup 260 to seal in the lower spool 240 and/or the inner surface of bridge connector 230, the lock pin can be actuated into mandrel lock 270 to mechanically fix the mandrel 250 into position. Other types of locking mechanisms may also be used, such as cams, dogs, or wing nuts.

The hydraulic setting cylinder 220 may be electronically controlled to actuate the mandrel 250. Similarly, the back-up mechanism, such as lock pin and mandrel lock 270 system, may also be actuated electronically or pneumatically. In this way, the flow paths within the zipper manifold 220 may be opened and closed remotely, thus enhancing worker safety. As described above, in an embodiment, manually actuated valves may also be used as an alternative or a backup to the hydraulically actuated cylinder 220.

Figure 5:
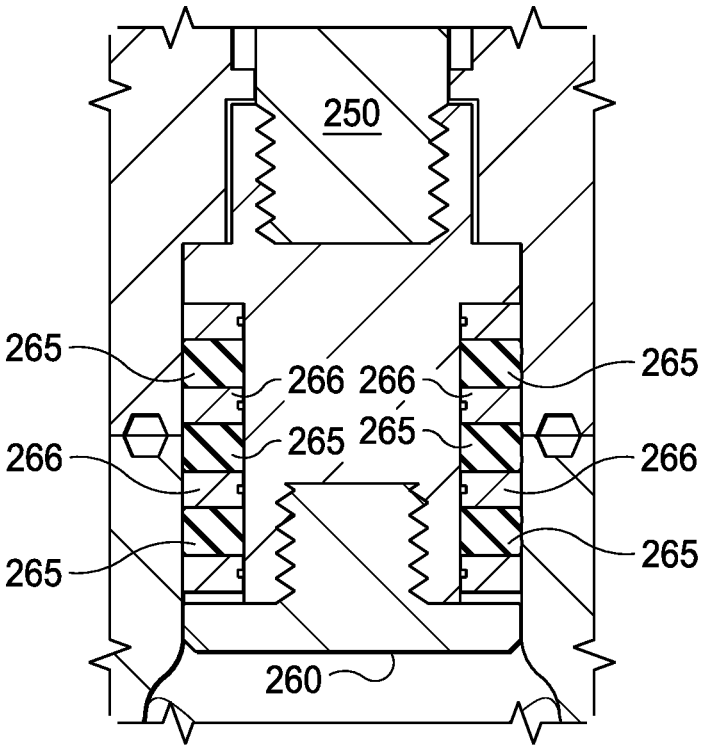
FIG. 5 is an enlarged view of a mandrel cup tool.

FIG. 5 illustrates a close up view of an exemplary sealing configuration for a mandrel cup tool 260. Cup tool 260 has o-rings 265 and plates 266, which act as pack off seals with the inner surface of the spools when the mandrel 250 is either above or below the bridge header connection 230.

Figure 6:
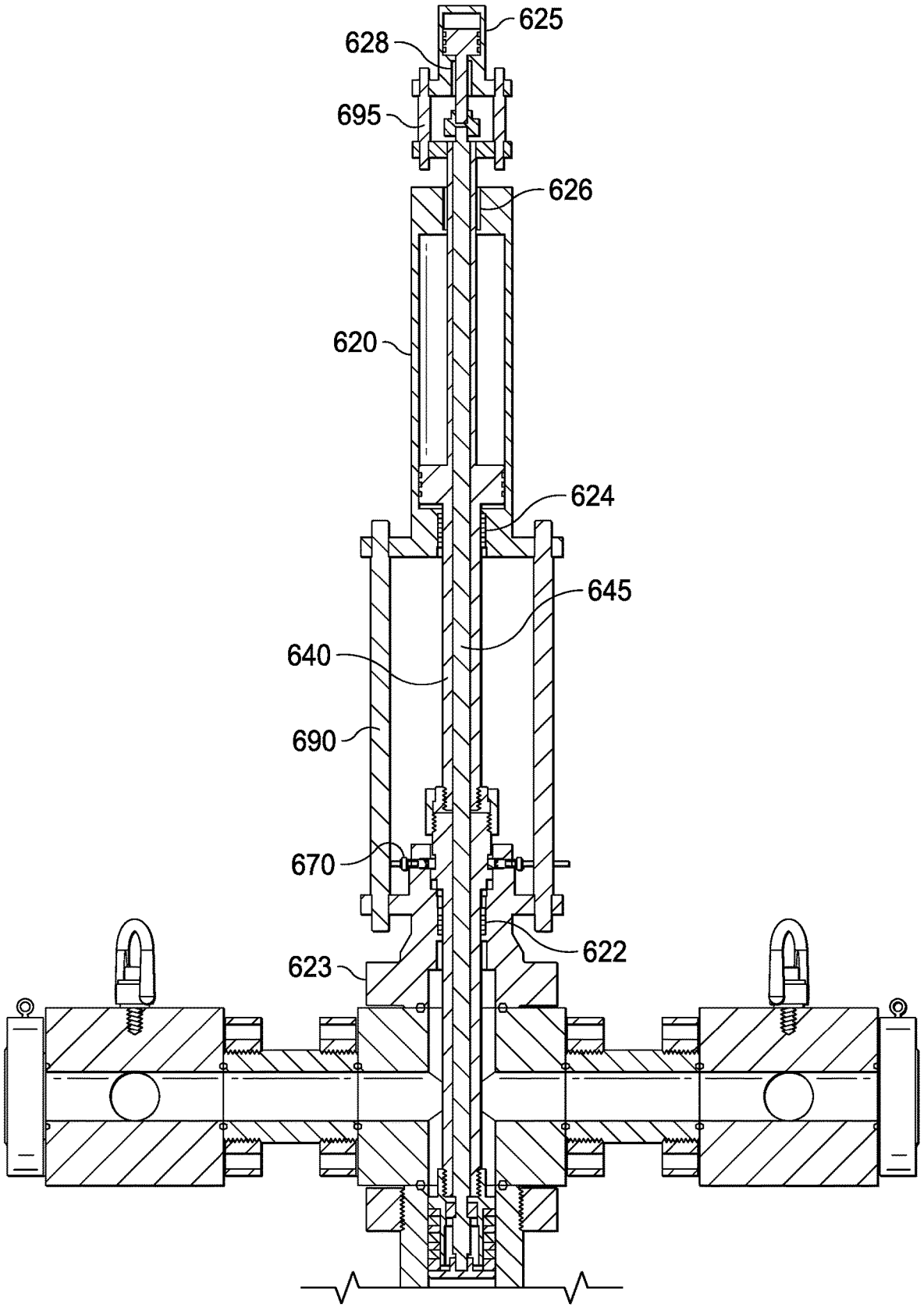
FIG. 6 illustrates an embodiment of a hydraulic setting cylinder with two mandrels and stay rods.
Figure 7:
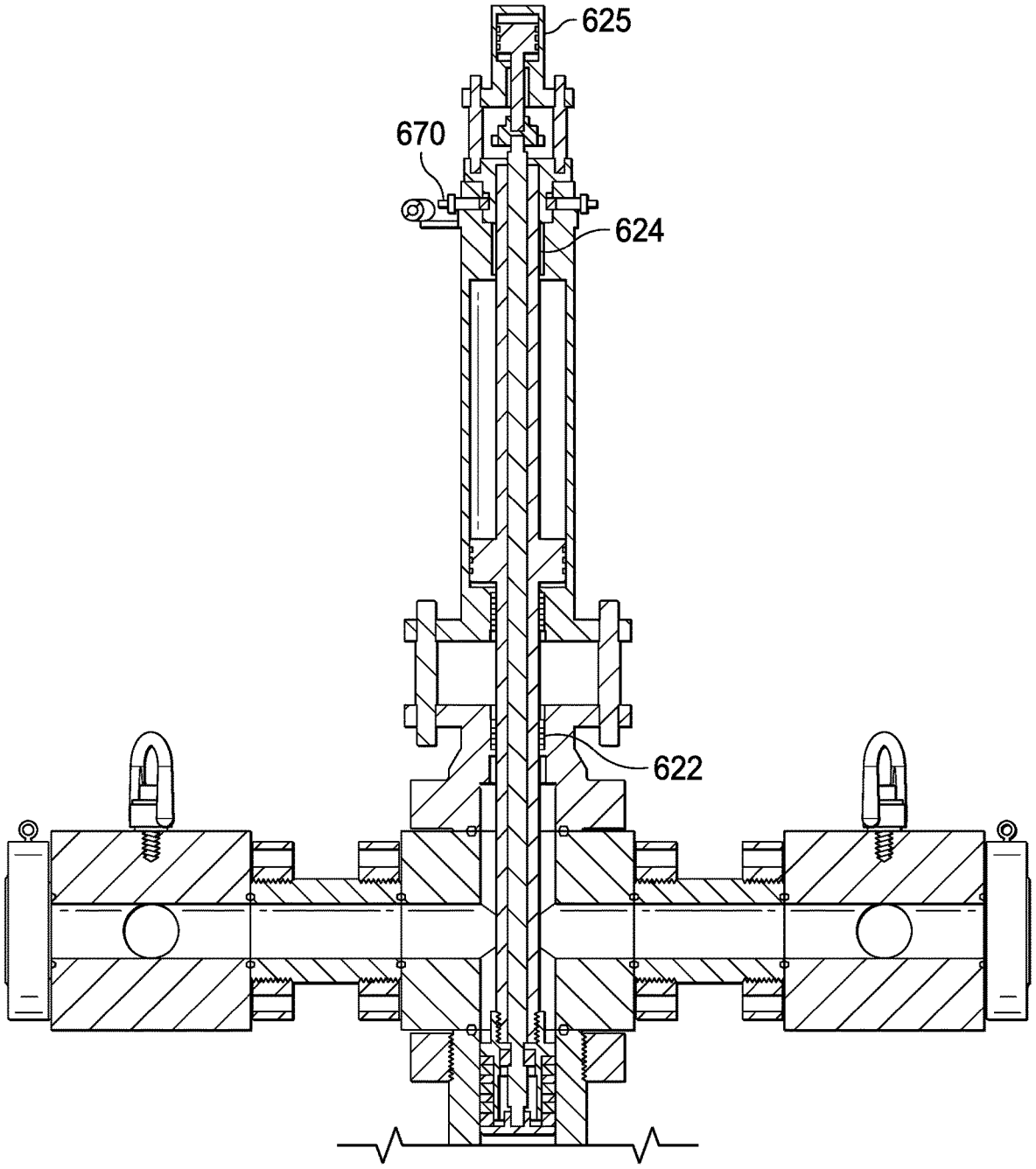
FIG. 7 illustrates an embodiment of a hydraulic setting cylinder with two mandrels and stay rods.
Figure 8:
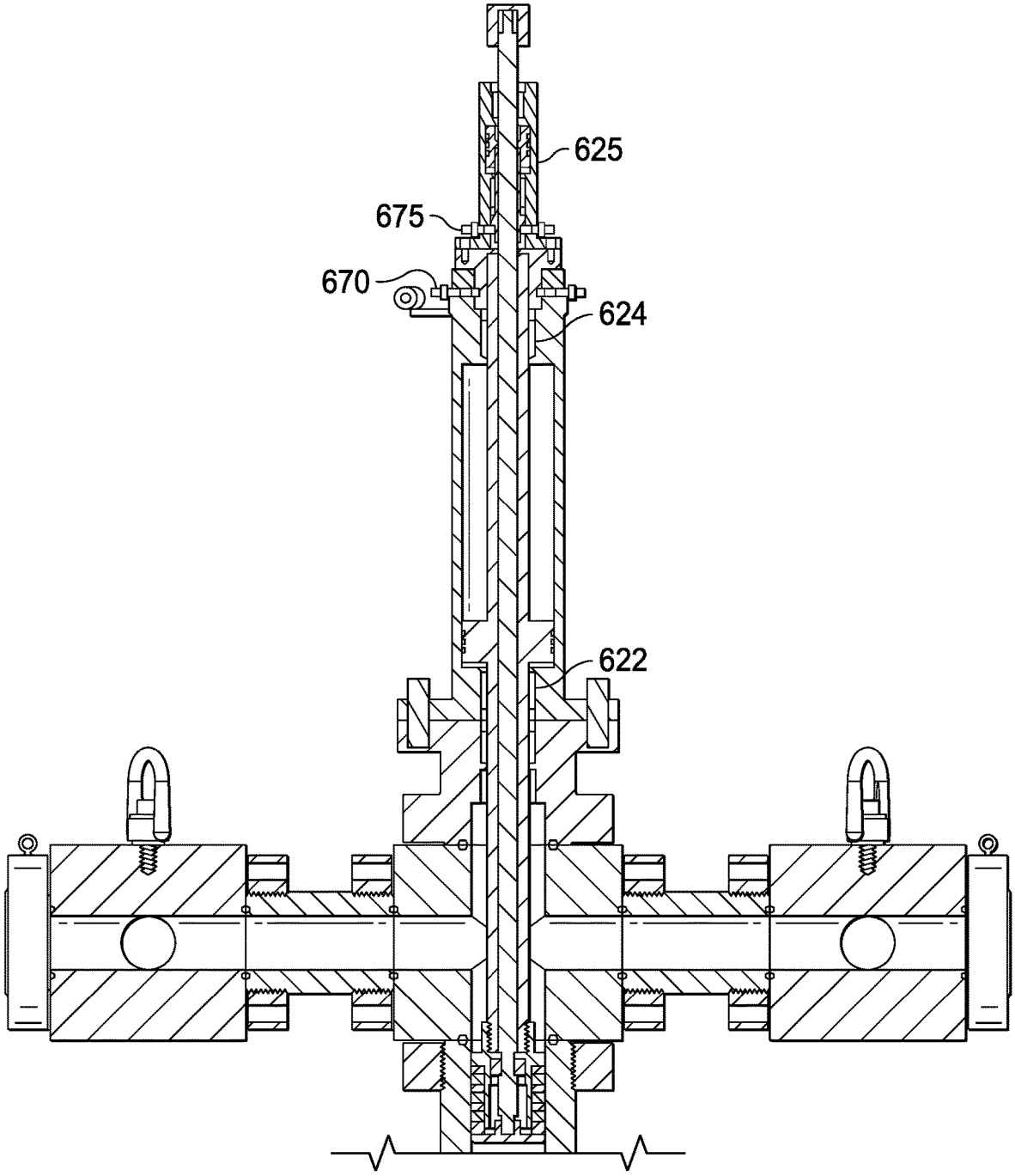
FIG. 8 illustrates an embodiment of a hydraulic setting cylinder with two mandrels.

FIGS. 6-8 show embodiments in which the mandrel system actuated by the hydraulic setting cylinder 620 may be a dual mandrel system. In the dual mandrel system, two concentric mandrels, an inner 645 and an outer 640, are used. The two mandrels 640 and 645 are moved together by the hydraulic setting cylinder 620 to position the mandrel cup tool 260 at the pack off location in either the open or closed position. The inner mandrel 645 can be moved independently of the outer mandrel 640 by a second hydraulic setting tool 625. Once the mandrel cup tool 260 has been positioned at the pack off location, the second hydraulic cylinder 625 is pressurized to move upwards, or away from the mandrel cup tool 260, which causes the inner mandrel 645 to move upward relative to the outer mandrel 640. The inner mandrel 645 is connected to one end of the mandrel cup tool 260 while the outer mandrel 240 is connected to the other. The upward movement of the inner mandrel 645 relative to the outer mandrel 640 causes the mandrel cup tool 260 to be compressed and the seals 265 to be extruded and form a seal at the pack off location.

FIG. 6 shows an embodiment in which the lock mechanism 670 is relatively close to the pack off location where the mandrel cup 260 will be positioned. The stay rods 690 provide access to the lock mechanism 670 and the packing boxes 622 and 624, but also increase the well configuration unit's overall height. The packing box 622 seals between the outer mandrel 640 and the flange 623 to prevent pressurized fluid from leaking out of the well configuration unit. Similarly, the packing box 624 provides a seal between the outer mandrel 640 and the hydraulic cylinder 620 to contain the pressurized fluid within the hydraulic cylinder 620. The stay rods 695 maintain the position of the inner mandrel 645 relative to the outer mandrel 640 and provide access to the packing boxes 626 and 628.

FIG. 7 shows an embodiment in which the lock mechanism 670 is positioned above the first hydraulic cylinder 620. The stay rods 690 and 695 are able to be shortened relative to those shown in FIG. 6, but still allow access to the packing boxes 622 and 624.

FIG. 8 illustrates an embodiment which does not use stay rods. Once a seal has been formed at the mandrel cup tool 260, the relative position of the inner mandrel 645 to the outer mandrel 625 may be fixed by a second lock mechanism 625 so that the seal is maintained. When the mandrel system needs to be moved again, from one position to another, the second lock mechanism is unlocked so that the inner and outer mandrels are able to move relative to each other. The inner and outer mandrels are moved relative to each other such that the sealing element does not form a seal against the spool, and then the mandrels may be moved together to the open or closed position.

Figure 9:
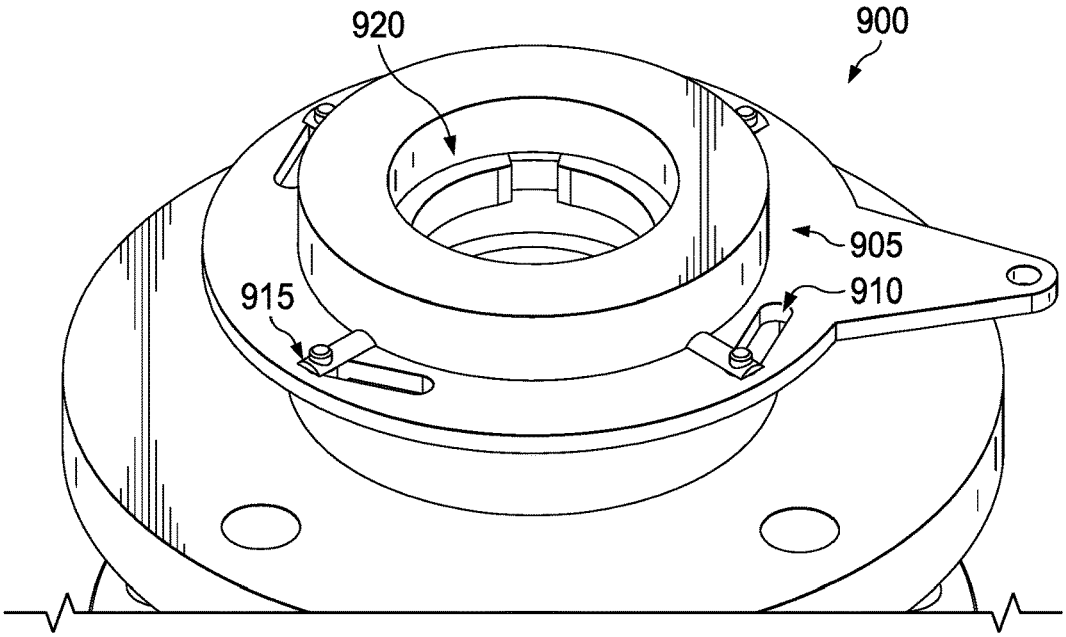
FIG. 9 illustrates an embodiment of a lock mechanism in the unlocked position.
Figure 10:
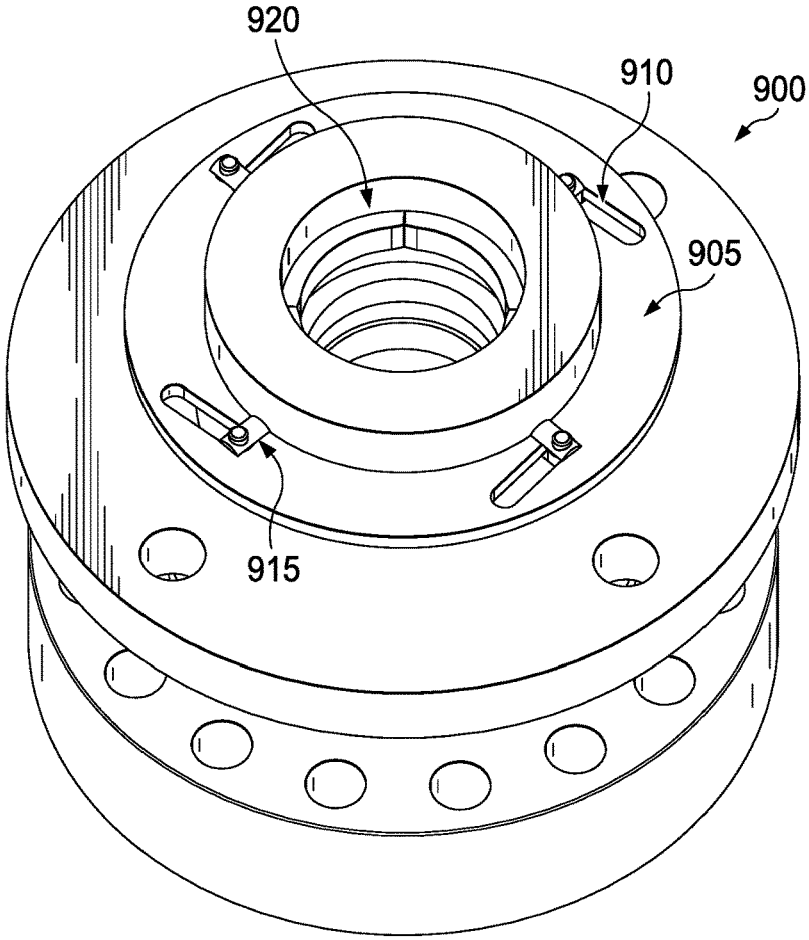
FIG. 10 illustrates a lock mechanism in the locked position.
Figure 11:
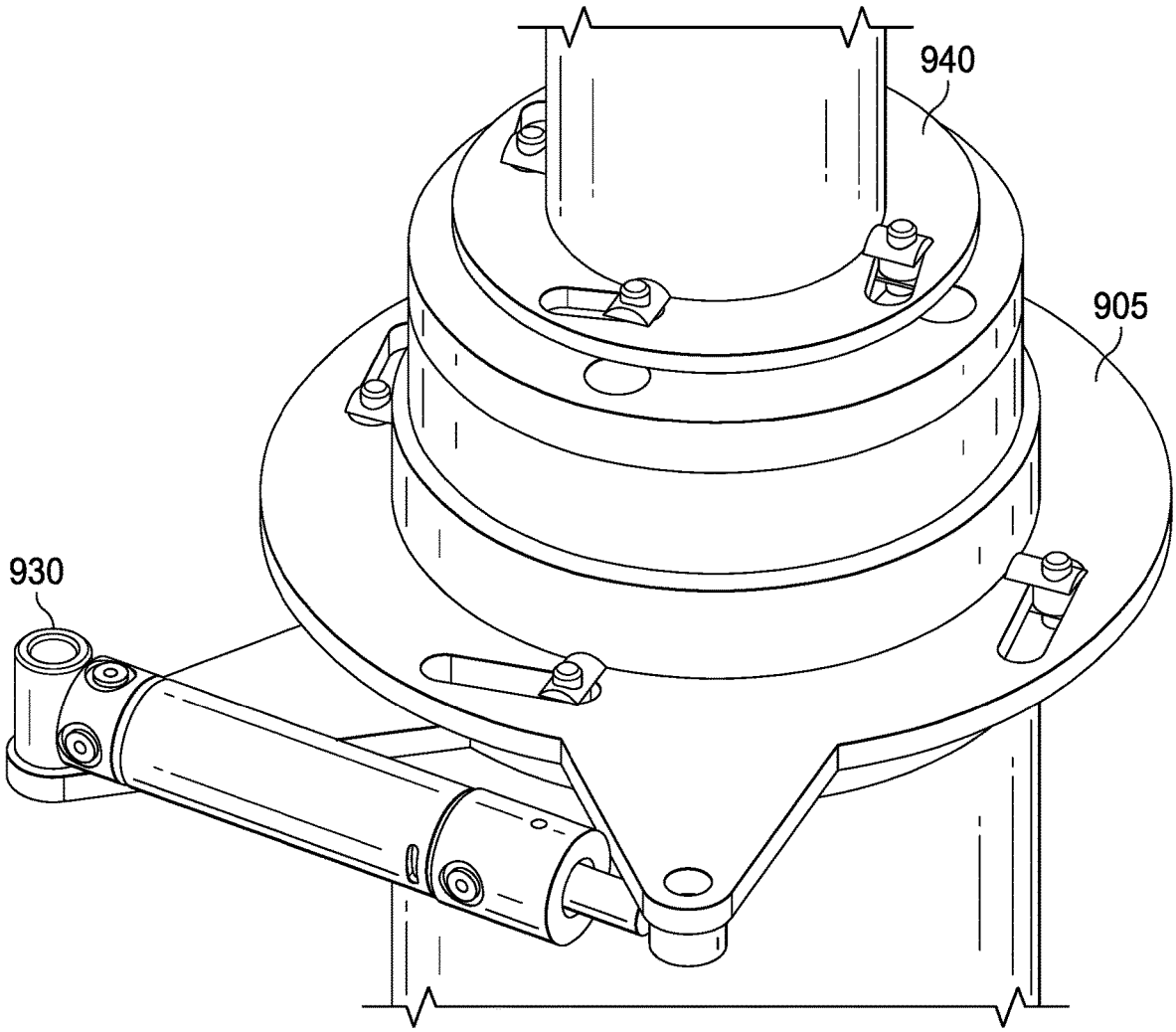
FIG. 11 illustrates a lock mechanism with a linear actuator.

FIGS. 9-11 illustrate an exemplary lock mechanism 900. The lock mechanism 900 may comprise a plate 905 which comprises slots 910. The slots 910 are positioned near the outer circumference of plate 905 and radially extend inward/outward, such that the radial distance from one end of the slot to the center of the plate 905 is different than the radial distance from the other end of the slot to the center of the plate 905. Pins 915 are engaged in the slots 910. Each pin 915 is connected to a lock segment 920, such that when the pins 915 travel along the slots 910, the change in radial distance for the pins 915 causes the lock segments 920 to correspondingly constrict or enlarge in inner circumference. The lock segments 920 circumscribe a mandrel, which is not shown in FIGS. 9-11. When the lock segments 920 are constricted, they engage the mandrel and lock it in place. The plate 905 can be rotated to cause the lock segments 920 to lock or unlock.

Figure 16:
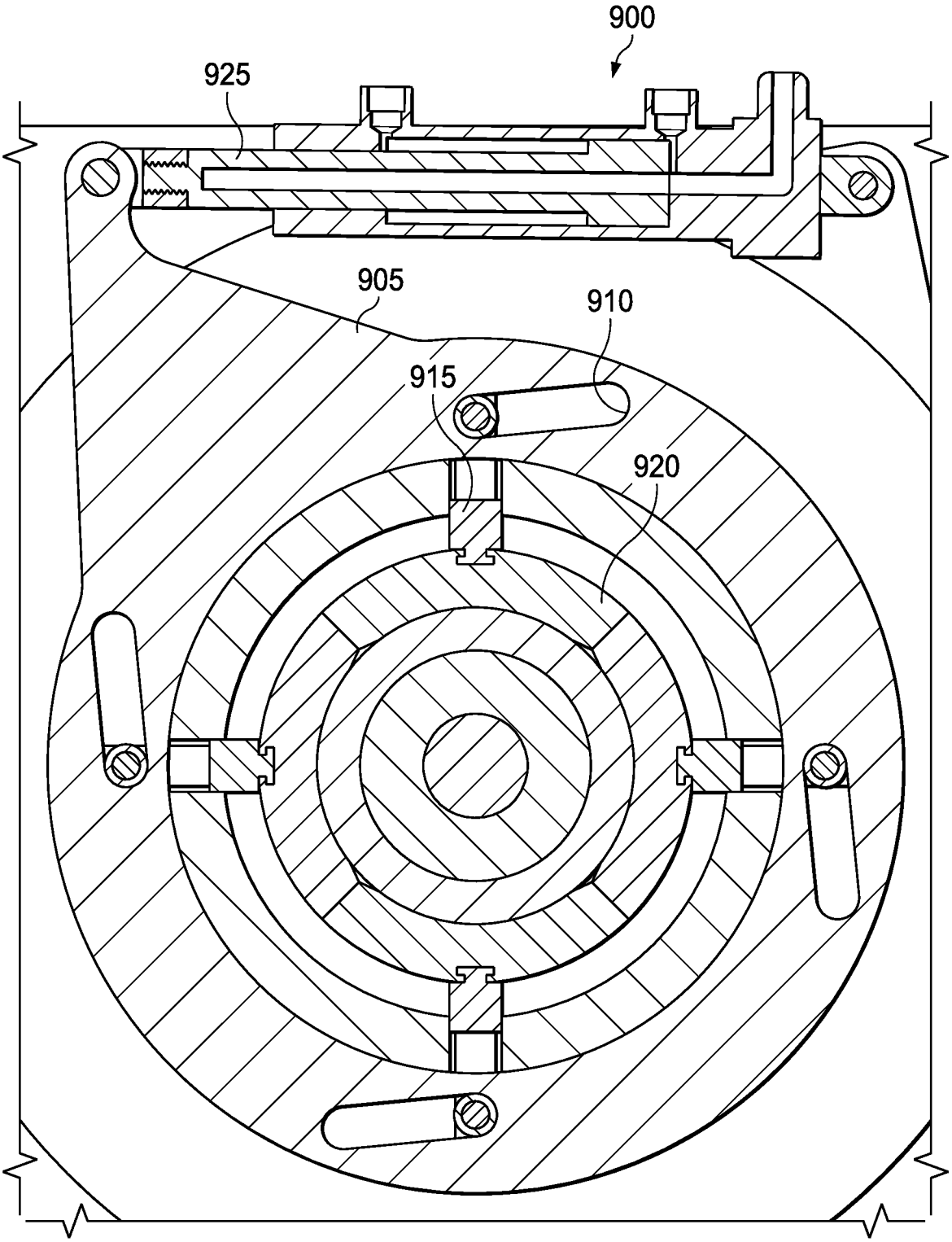
FIG. 16 illustrates a top view of the lock mechanism shown in FIG. 10.

FIG. 9 illustrates the lock mechanism 900 in an unlocked position, FIG. 10 illustrates the lock mechanism 900 in a locked position. FIG. 11 illustrates that a linear actuator may be used to rotate the plate 905 to lock and unlock the lock mechanism. FIG. 11 further illustrates a second lock mechanism 940, which may be similarly locked or unlocked using a linear actuator. FIG. 16 illustrates a top view of lock mechanism 900 in a locked position.

Figure 12:
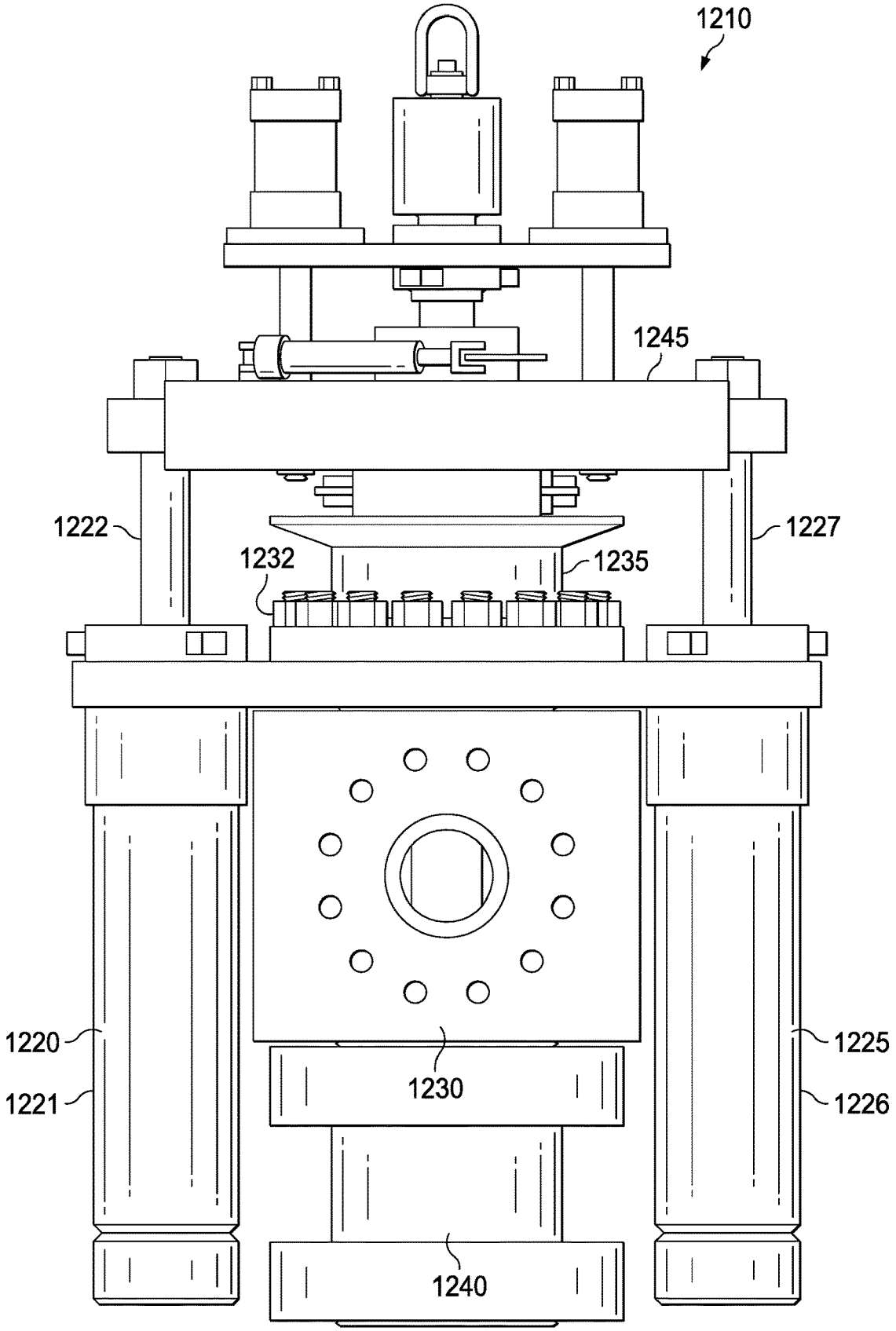
FIG. 12 illustrates an alternative embodiment of an improved zipper manifold.

FIG. 12 illustrates an alternative embodiment of an improved well configuration unit 1210. Improved well configuration unit 1210 includes two hydraulic setting cylinders 1220 and 1225. Setting cylinders 1220 and 1225 comprise outer housings 1221 and 1226 respectively, which are connected to flange 1235. Flange 1235 is connected to bridge connector header 1230 via bolts 1232. Bridge connector header 1230 forms a "T" junction with a lower bore, such as lower spool 1240, similar to the above discussion concerning the embodiment shown in FIGS. 2-11. As with that above discussion, it is not necessary for bridge connector header to include two throughbores, as long as it has one throughbore to serve as a fluid inlet and a second bore to serve as a fluid outlet.

Figure 13:
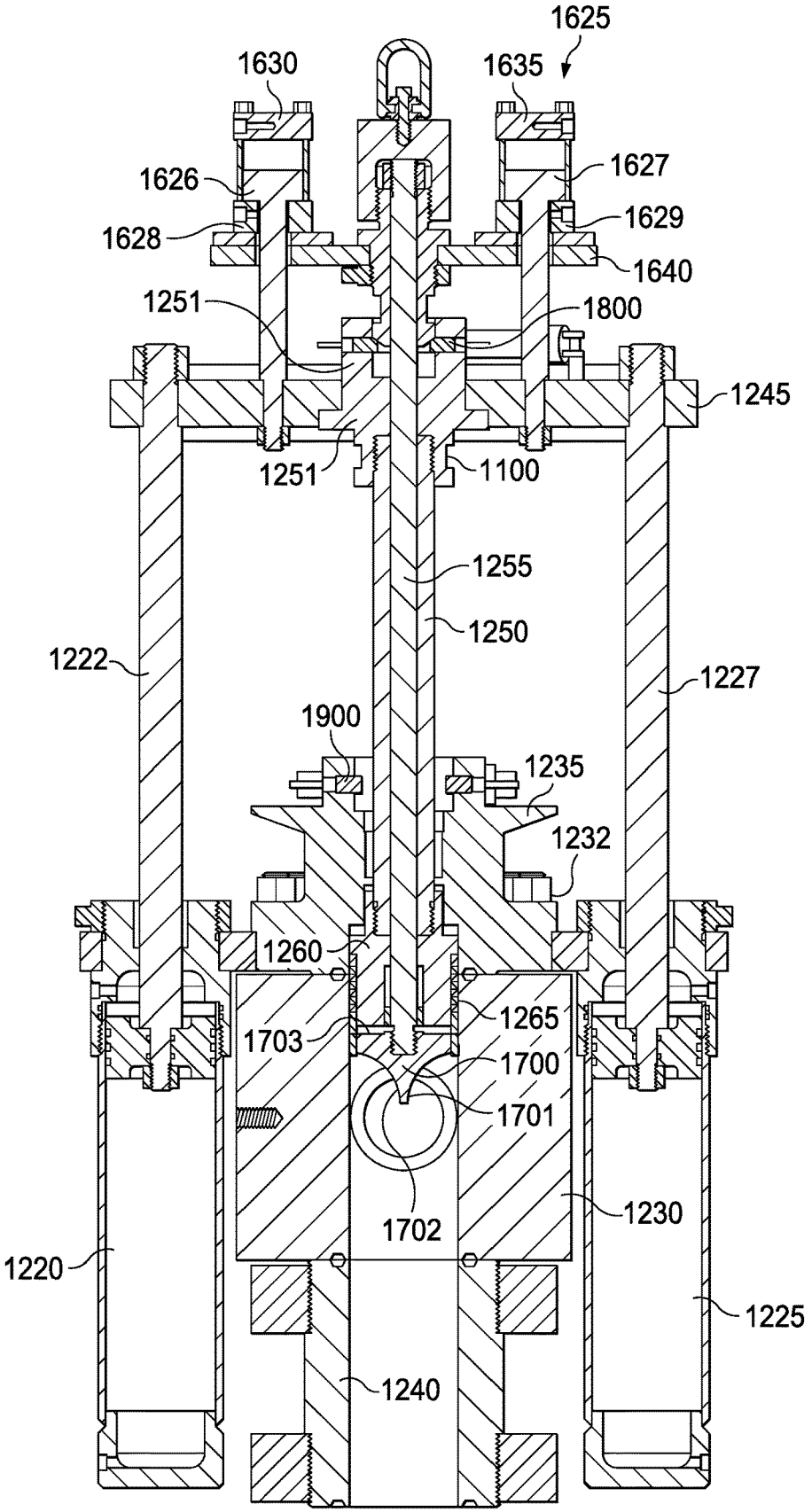
FIG. 13 illustrates the embodiment of FIG. 12 with the mandrel in the open position.

Setting cylinders 1220 and 1225 also comprise rods 1222 and 1227 respectively. Rods 1222 and 1227 each comprise an upper end, each of which is connected to lower plate 1245. As shown in FIG. 13, lower plate 1245 is also connected to mandrel head 1251, which is in turn connected to outer mandrel 1250. Cup tool 1260, comprising gage ring 1261 and seals 1265, is located at the lower end of outer mandrel 1250.

Similar to the embodiment shown in FIGS. 6-8, improved well configuration unit 1210 comprises a dual mandrel system. In the dual mandrel system, two concentric mandrels, an inner 1255 and an outer 1250, are used. Inner mandrel 1255 comprises a lower end which is connected to compression member 1700. Compression member 1700 comprises a generally planar surface 1703 and may also comprise concave lower surfaces 1701 and 1702, which may serve to divert high-pressure flow and protect the integrity of seals 1265.

Figure 15:
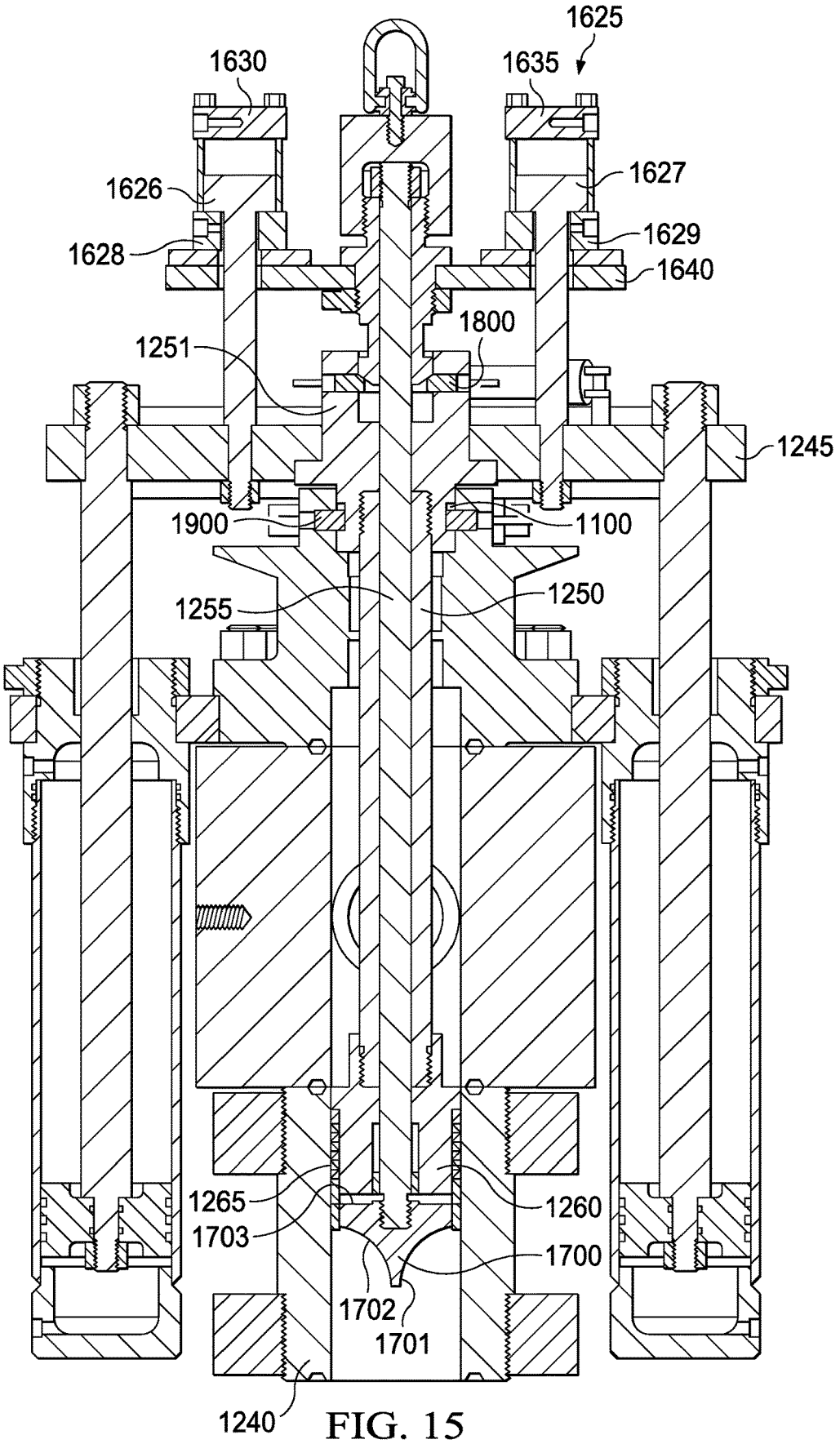
FIG. 15 illustrates the embodiment of FIG. 12 with the mandrel in the closed position, after the seal is set.

As described in further detail below, the two mandrels 1255 and 1250 are moved together by the setting cylinders 1220 and 1225 to position the cup tool 1260 at the pack off location below bridge connector header 1230, as shown in FIG. 15.

The inner mandrel 1255 can be moved independently of the outer mandrel 1250 by a second hydraulic setting tool 1625. Second hydraulic setting tool 1625 comprises hydraulic cylinders 1630 and 1635, which are connected to upper plate 1640. Hydraulic cylinders 1630 and 1635 comprise outer housings 1628 and 1629 respectively, which are connected to upper plate 1640. Hydraulic cylinders 1630 and 1635 also comprise rods 1626 and 1627 respectively. Rods 1626 and 1627 each comprise a lower end, each of which is connected to lower plate 1245.

Figure 14:
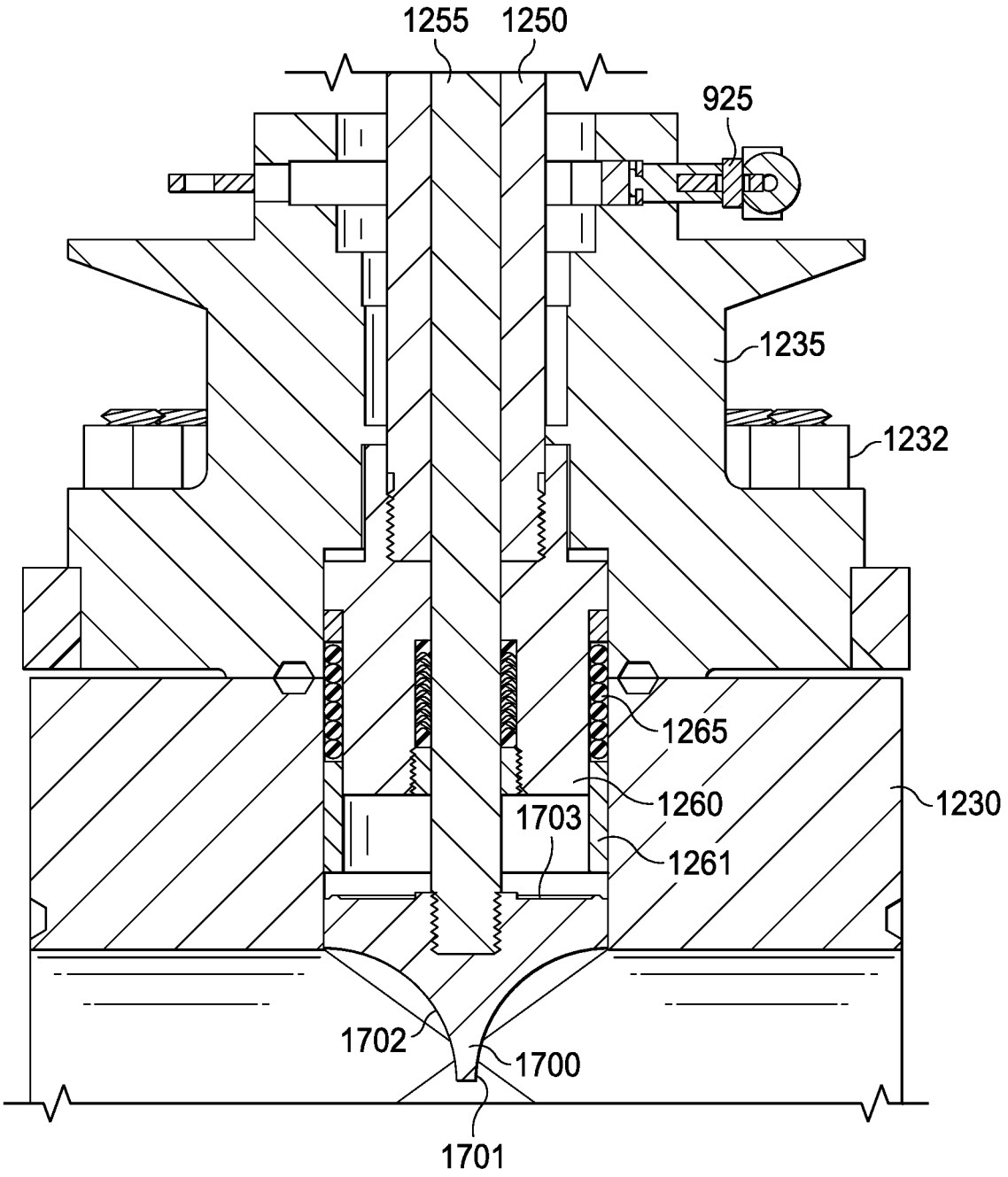
FIG. 14 is an enlarged view of the bottom portion of the mandrel shown in FIG. 13.

In operation, improved well configuration unit 1210 begins in the position shown in FIG. 13, with cup tool 1260 located above bridge connector header 1230. In this position, fluid is free to flow through bridge connector header 1230. The position of the cup tool is shown in more detail in FIG. 14.

When the operator desires to seal bridge connector header 1230, hydraulic fluid is injected into the upper portion of hydraulic setting cylinders 1220 and 1225, thereby forcing rods 1222 and 1227 downward. Due to the connection between rods 1222 and 1227 and lower plate 1245, as well as the connection between lower plate 1245 and mandrel head 1251, the downward movement of rods 1222 and 1227 causes outer mandrel 1250 to move downward through bridge connector 1230 and into lower spool 1240 to the point that cup tool 1260 is located below the "T" junction of bridge connector header 1230 as shown in FIG. 15. In addition, due to the connection between rods 1626 and 1627 and upper plate 1640, inner mandrel 1255 and compression member 1700 also move downward towards lower spool 1240.

Once the cup tool 1260 has been positioned at the pack-off location, and the operator desires to engage seals 1265, hydraulic cylinders 1630 and 1635 are pressurized such that rods 1626 and 1627 move upwards, or away from the cup tool 1260, which causes the inner mandrel 1255 to move upward relative to the outer mandrel 1250. When this happens, upper surface 1703 of compression member 1700 contacts the lower surface of gage ring 1261 of cup tool 1260. Because the upper surface of gage ring 1261 contacts seals 1265, continued upward movement of inner mandrel 1255 and compression member 1700 causes gage ring 1261 to compress seals 1265, with the result that seals 1265 are extruded outward and form a seal within lower spool 1240 and/or the inner surface of bridge connector 1230.

Improved well configuration unit 1210 may also comprise upper lock mechanism 1800 and lower lock mechanism 1900. Upper lock mechanism 1800 and lower lock mechanism 1900 are generally structured consistent with the design discussed above in connection with lock mechanism 900, and shown in FIGS. 9-11 and 16. The linear actuator for upper lock mechanism 1800 and lower lock mechanism 1900 may comprise hydraulic cylinder 925. As will be understood by those of ordinary skill in the art, the linear actuator may also comprise an electronic actuator.

As illustrated in FIG. 15, lower lock mechanism 1900 is locked when cup tool 1260 has been moved into position below bridge connector header 1230. The lock segments of lower lock mechanism 1900 engage with a groove 1100 on the outer surface of the mandrel head 1251. This engagement prevents outer mandrel 1250 from being forced upward by high-pressure fluid within lower spool 1240, and thus maintains the integrity of the seal formed by seals 1265.

Figure 17:
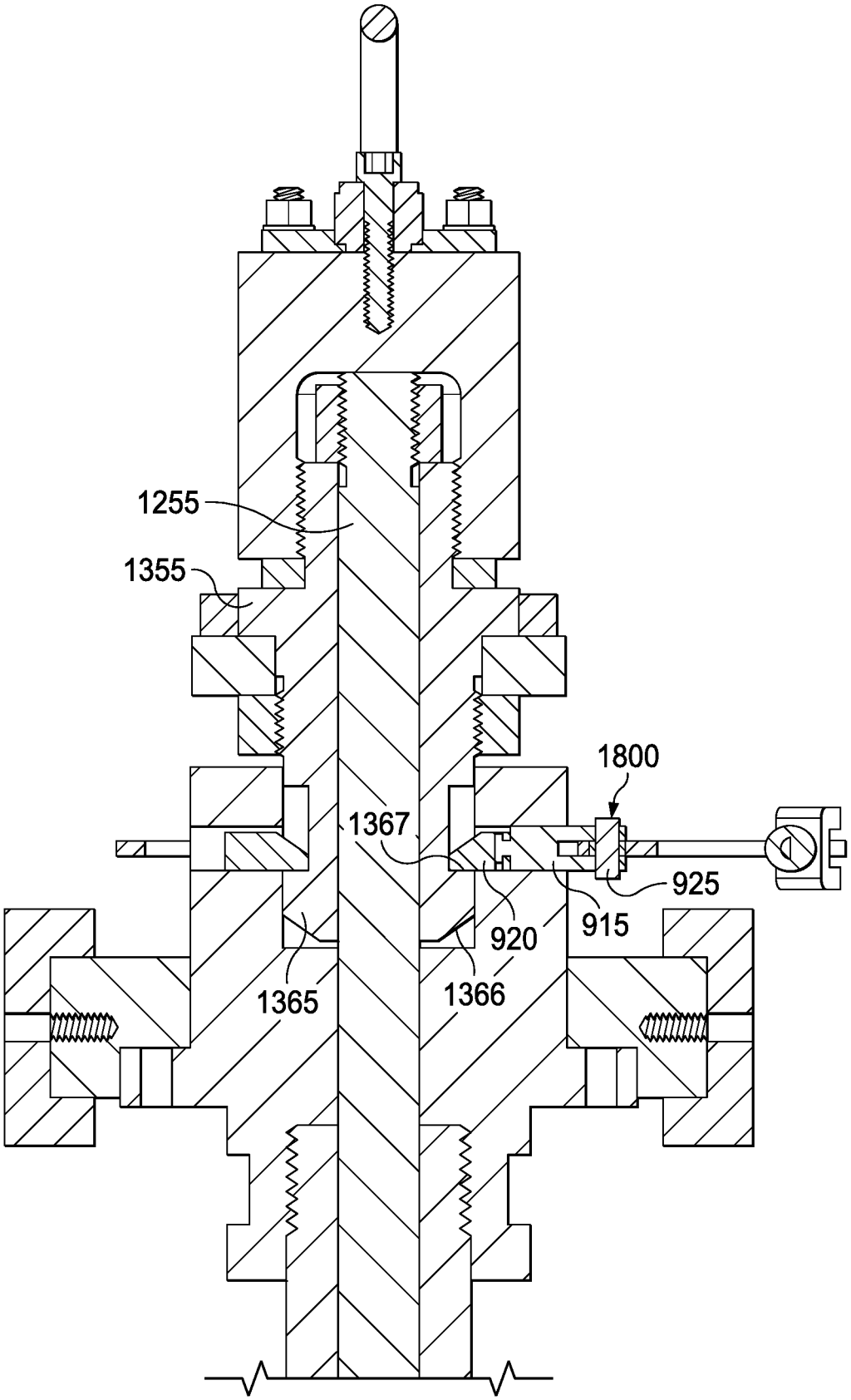
FIG. 17 illustrates the position of an upper locking ring when the mandrel is in the closed position, but prior to the seal being set.
Figure 18:
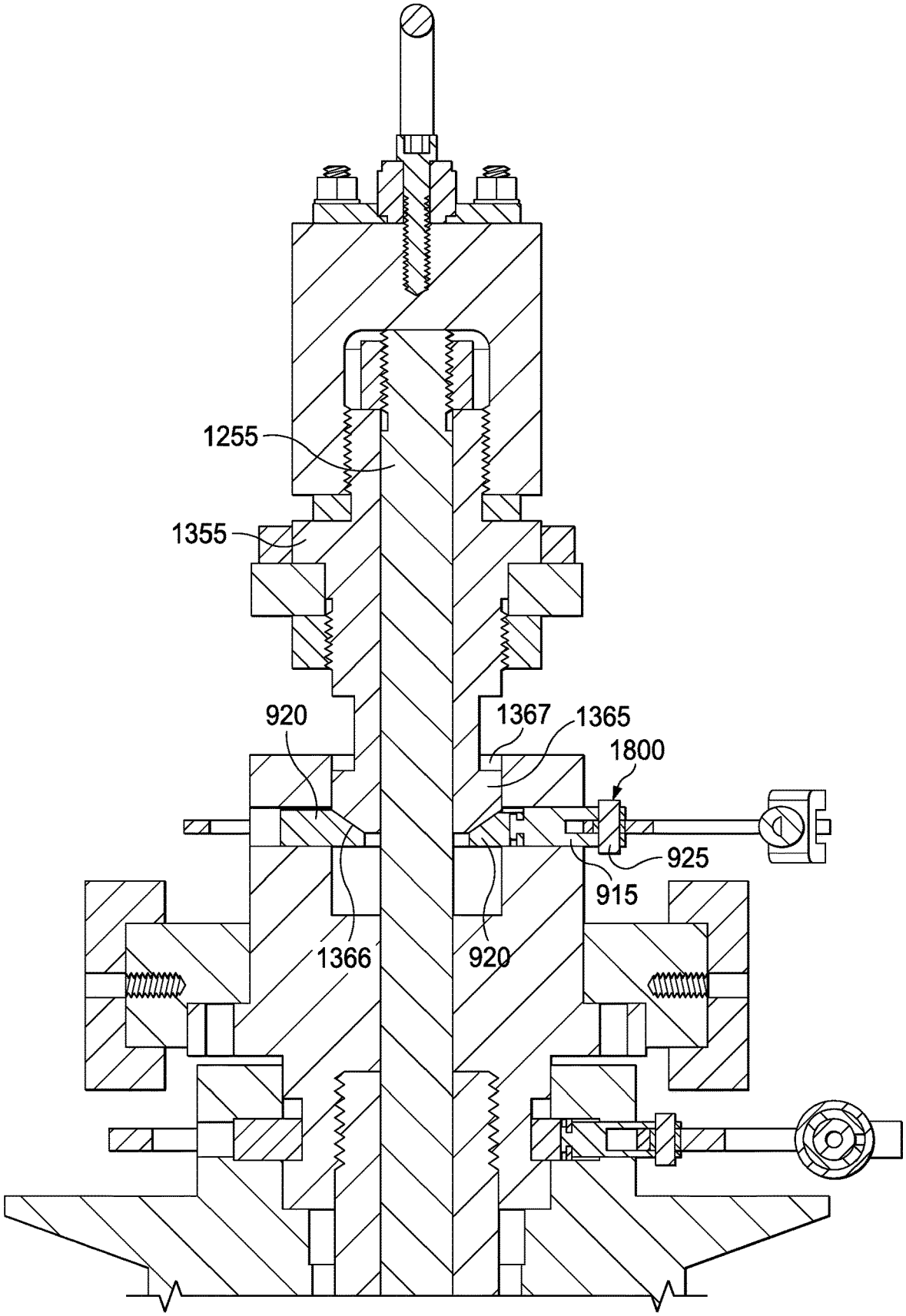
FIG. 18 illustrates the position of an upper locking ring when the mandrel is in the closed position and the seal has been set.

As shown in FIGS. 17 and 18, upper lock mechanism 1800 may be engaged in two distinct positions. FIG. 17 illustrates improved well configuration unit 1210 when cup tool 1260 has been moved into the pack-off location below bridge connector header 1230, but before seals 1265 have been engaged. Inner mandrel 1255 comprises inner mandrel head 1355, which also comprises lower portion 1365. Lower portion 1365 comprises a beveled lower face 1366 and a planar upper face 1367. As shown in FIG. 17, before seals 1265 have been engaged, upper lock mechanism 1800 is locked such that its segments 920 engage with planar upper face 1367 of lower portion 1365 of inner mandrel head 1355. In this position, seals 1265 cannot be engaged until upper lock mechanism 1800 is disengaged.

FIG. 18 illustrates improved well configuration unit 1210 when cup tool 1260 has been moved into the pack-off location below bridge connector header and after seals 1265 have been engaged by the upward movement of inner mandrel 1255 and compression member 1700. As shown in FIG. 17, upper lock mechanism 1800 is locked such that its segments 920 engage with beveled lower face 1366 of lower portion 1365 of inner mandrel head 1355. In this position, inner mandrel 1255 and compression member 1700 may not be moved downward, thereby disengaging seals 1265, until upper lock mechanism 1800 is disengaged.

Figure 19:
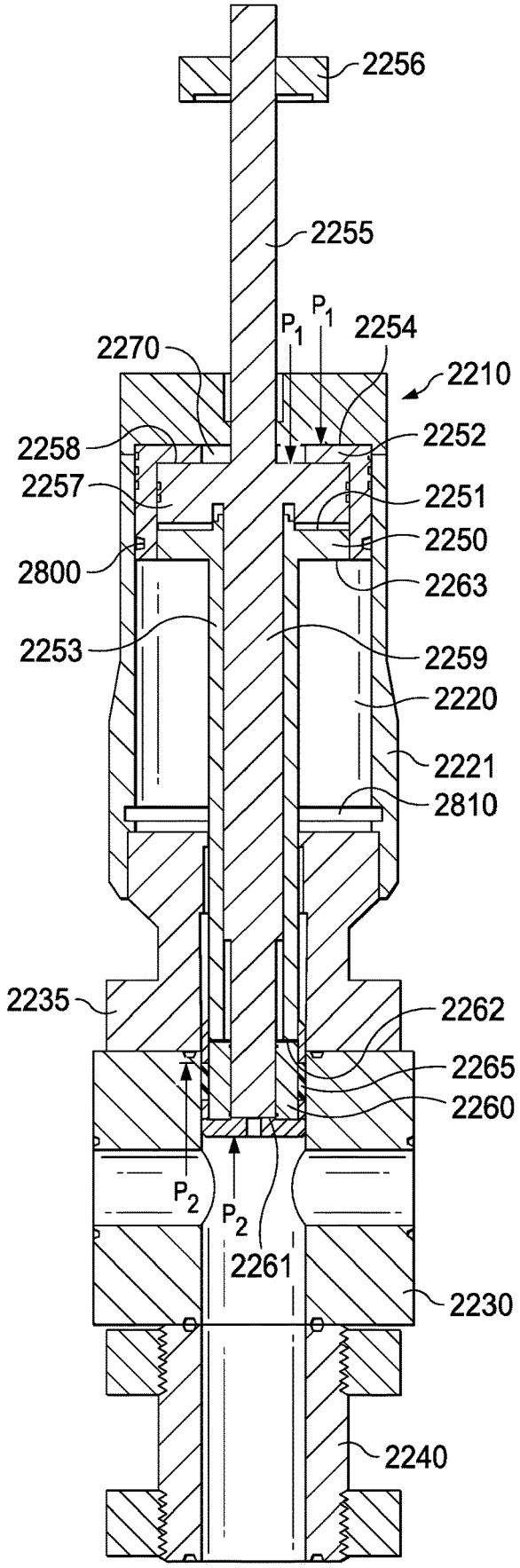
FIG. 19 illustrates an alternative embodiment of an improved zipper manifold before the initial movement of either mandrel.
Figure 20:
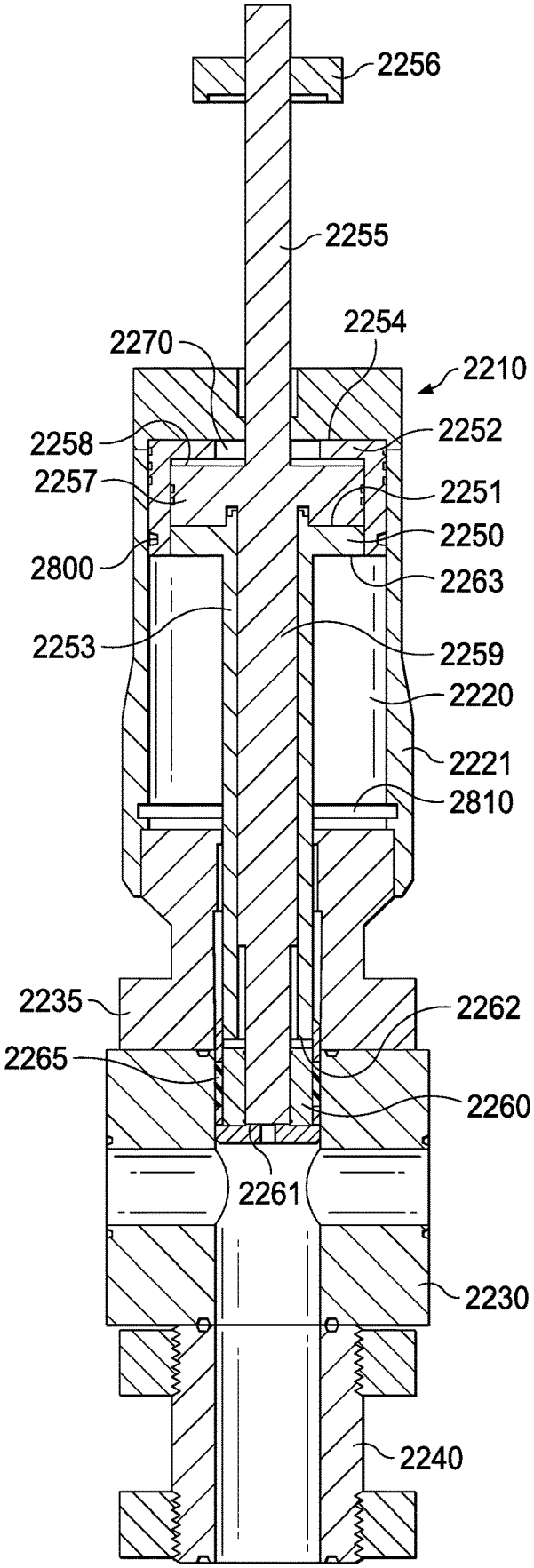
FIG. 20 illustrates the embodiment of FIG. 19 after the initial movement of the inner mandrel but before the initial movement of the outer mandrel.

FIG. 19 illustrates an alternative embodiment of an improved well configuration unit 2210. Improved well configuration unit 2210 includes hydraulic setting cylinder 2220. Setting cylinder 2220 comprises outer housing 2221, which is connected to flange 2235. Flange 2235 is connected to bridge connector header 2230 via bolts (not shown). Bridge connector header 2230 forms a "T" junction with a lower bore, such as lower spool 2240, similar to the above discussion concerning the embodiment shown in FIGS. 2-11. As with that above discussion, it is not necessary for bridge connector header to include two throughbores, as long as it has one throughbore to serve as a fluid inlet and a second bore to serve as a fluid outlet.

Similar to embodiments described above, improved well configuration unit 2210 comprises a dual mandrel system that includes two concentric mandrels, an inner 2255 and an outer 2250. Inner mandrel 2255 comprises mandrel stop 2256, annular portion 2257 with upper surface 2258, rod 2259, cup tool 2260, and lower surface 2261. Upper surface 2258 has a surface area $A_{i.u}$. Cup tool 2260, comprising seals 2265, is located towards the lower end of inner mandrel 2255. Lower surface 2261 has a surface area $A_{i.l}$.

Outer mandrel 2250 comprises upper housing 2252 and lower housing 2253. Upper housing 2252 comprises upper surface 2254, inner chamber 2251, dogs 2800, and lower surface 2263. Upper surface 2254 has a surface area $A_o$. Lower housing 2253 comprises lower surface 2262, which has a surface area $A_{o.1}$. Annular portion 2257 of inner mandrel 2255 is disposed within chamber 2251. Rod 2259 of inner mandrel 2255 is disposed within lower housing 2253. Lower surface 2262 is adjacent to cup tool 2260, and configured to compress seals 2265 once cup tool 2260 has reached the pack-off position. Compression by lower surface 2262 causes seals 2265 to extrude outward, thus forming a seal with the inner surface of bridge connector 2230 and/or lower spool 2240.

Figure 21:
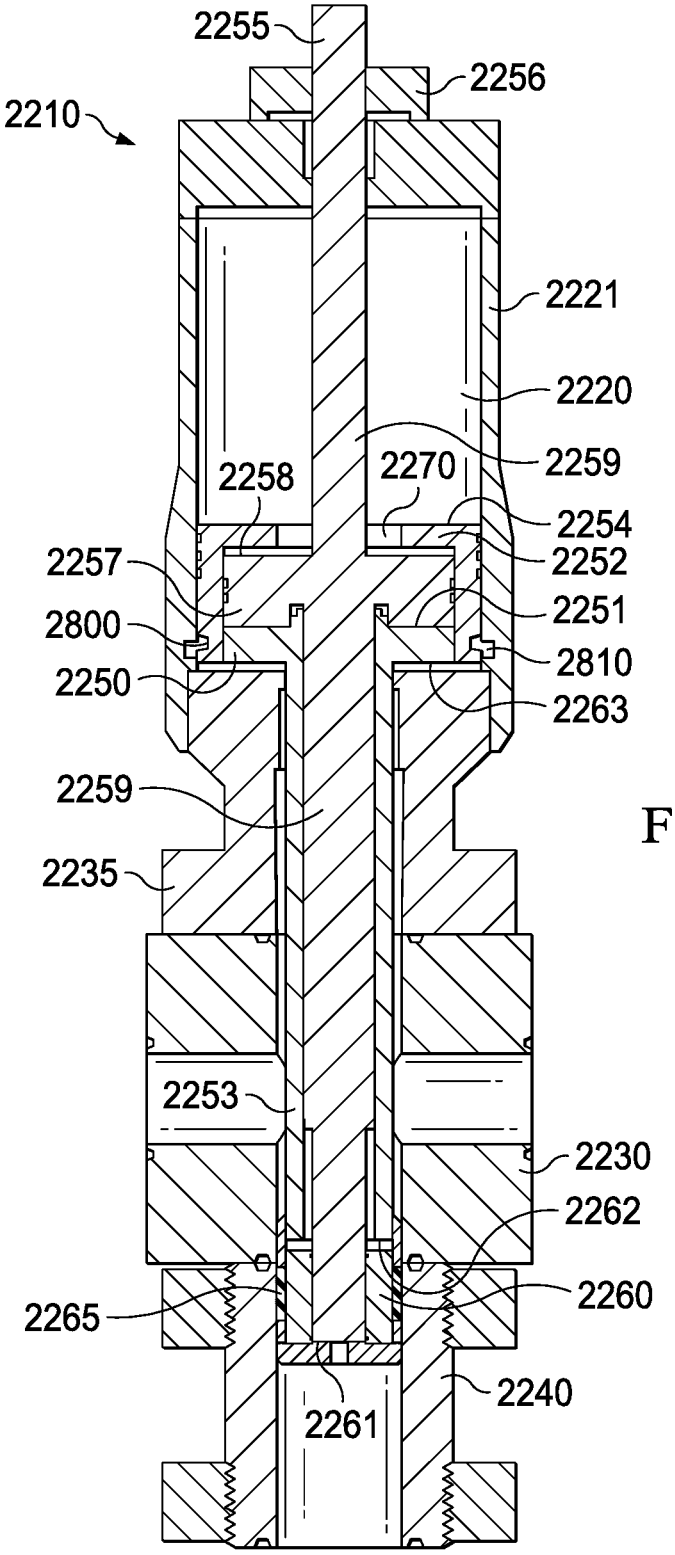
FIG. 21 illustrates the embodiment of FIG. 19 after the seal has been moved to the pack-off position but prior to the seal being set.

As described in further detail below, inner mandrel 2255 is moved independently by the setting cylinder 2220 to position the cup tool 2260 at the pack off location below bridge connector header 2230, as shown in FIG. 21.

In operation, improved well configuration unit 2210 begins in the position shown in FIG. 19, cup tool 2260 located above the "T" junction formed by bridge connector header 1230 and lower spool 2240. In this position, fluid is free to flow through bridge connector header 2230.

When the operator desires to seal bridge connector header 2230, hydraulic fluid is injected into the upper portion of hydraulic setting cylinder 2220. Upper housing 2252 may optionally include orifice 2270 in a central portion of upper surface 2254. Alternatively, upper surface 2254 may not extend radially inward at all, such that the entire upper surface 2258 of inner mandrel 2255 is exposed. Regardless, when hydraulic fluid is injected into the upper portion of hydraulic setting cylinder 2220, it will exert pressure $P_1$ on both upper surface 2258 of inner mandrel 2255 and upper surface 2254 of outer mandrel 2250. Upper surface 2254 of outer mandrel 2250 may optionally comprise passages to facilitate the movement of hydraulic fluid across said surface and towards orifice 2270.

In addition to the downward pressure $P_1$ exerted by hydraulic fluid injected by the operator, upward pressure $P_2$ will generally be exerted on lower surfaces 2261 and 2262 due to the pressure of fluid within bridge connector 2230 and/or lower spool 2240.

It is preferable that inner mandrel 2255 initially move downward in response to hydraulic fluid pressure before the initial downward movement of outer mandrel 2250. If outer mandrel 2250 moves downward before inner mandrel 2255, lower surface 2262 of outer mandrel 2250 will compress seals 2265 before cup tool 2260 has reached the pack-off position. In that event, seals 2265 may prematurely extrude outward and form a seal with the inner surface of bridge connector 2230. This can cause damage to seals 2265 when inner mandrel 2255 continues to move downward to the point that cup tool 2260 has reached a pack-off position.

In general, inner mandrel 2255 will move downward before outer mandrel 2250 if the ratio between the downward force on inner mandrel 2255 ($F_{i.d}$) and the upward force on inner mandrel ($F_{i.u}$) exceeds the ratio between the downward force on outer mandrel ($F_{o.d}$) and the upward force on outer mandrel 1250 ($F_{o.u}$). Expressed differently, the device will work as intended if:

$$F_{i.d}/F_{i.u}>F_{o.d}/F_{o.u}.$$

In the particular design shown in FIGS. 19-22, initial movement of inner mandrel 2255 can be accomplished by controlling surface areas $A_i$, $A_o$, $A_{i.1}$, and $A_{o.1}$. The respective forces on inner mandrel 2255 and outer mandrel 2250 will be determined as follows:

$$F_{i.d}=(P_1)(A_i)$$

$$F_{i.u}=(P_2)(A_{i.1})$$

$$F_{o.d}=(P_1)(A_o)$$

$$F_{o.u}=(P_2)(A_{o.1}).$$

Because pressures $P_1$ and $P_2$ are both exerted on upper and lower surfaces respectively of both inner mandrel 2255 and outer mandrel 2250, inner mandrel 2255 will begin moving downward before outer mandrel 2250 if the following inequality is satisfied:

$$A_i/A_{i.1}>A_o/A_{o.1}.$$

Once inner mandrel 2255 has moved downward to the point that cup tool 2260 is at the pack-off location, mandrel stop 2256 will engage the exterior of outer housing 2221, as shown in FIG. 21, thus preventing further downward movement of inner mandrel 2255. The mandrel stop could take a form other than that depicted in FIG. 21. For example, the mandrel stop could be a radially extending annular shoulder that is rigidly connected to the interior of outer housing 2221 and contacts a corresponding shoulder of the inner mandrel 2255 when cup tool 2260 is at the pack-off location. The mandrel stop could also be one or more axially extending rods or shafts rigidly connected to the inner mandrel 2255 and configured to contact any portion of the interior or exterior of outer housing 2221 (or any other portion of well configuration unit 2210) and/or rigidly connected to the interior or exterior of outer housing 2221 and configured to contact any portion of inner mandrel 2255. Essentially any structure that prevents further downward movement of inner mandrel 2255 once cup tool 2260 is at the pack-off position can serve as the mandrel stop.

At that point, hydraulic pressure $P_1$ will continue to act upon upper surface 2254 of outer mandrel 2250. That continued downward pressure will cause outer mandrel 2250 to continue to move downward, such that lower surface 2262 engages with and compresses seals 2265. As explained above, this compression will cause seals 2265 to extrude outward, thus forming a seal with the inner surface of bridge connector 2230 and/or lower spool 2240.

Figure 22:
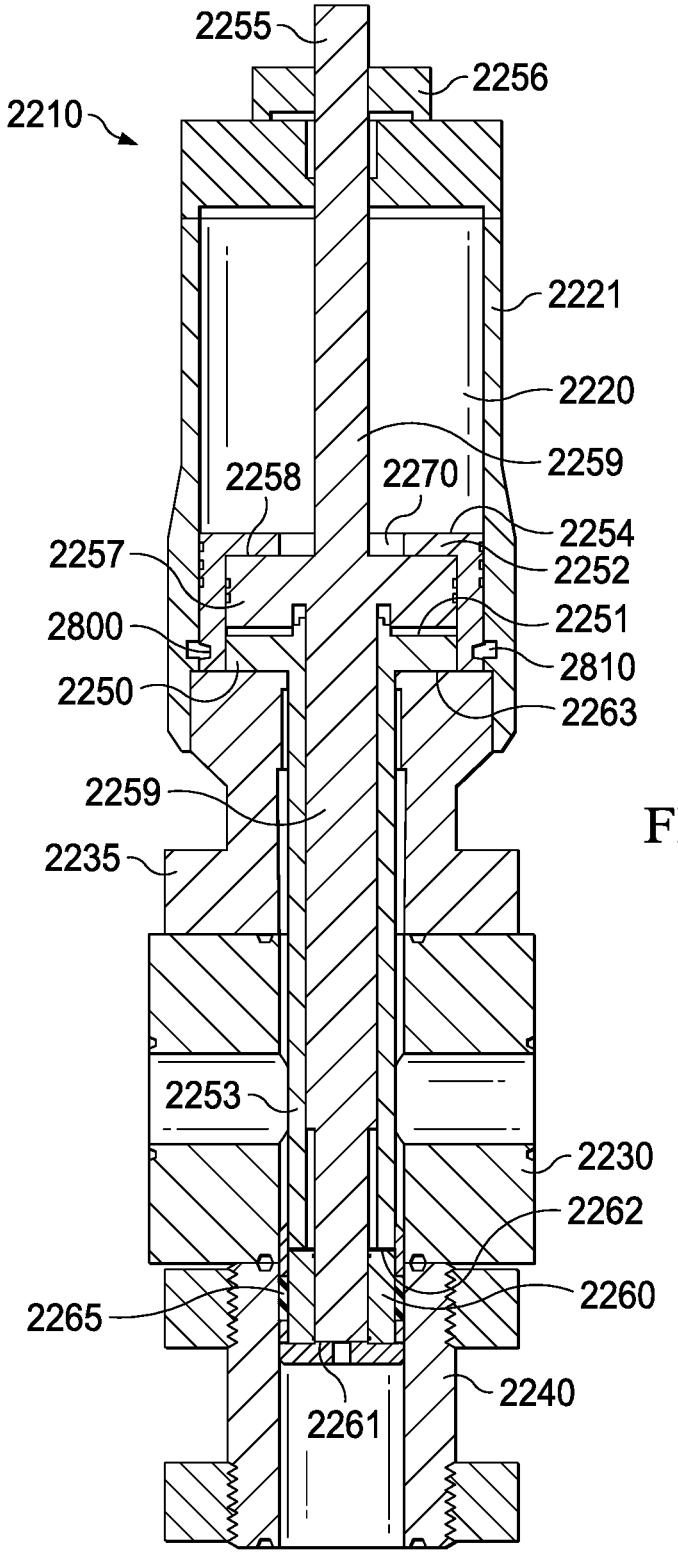
FIG. 22 illustrates the embodiment of FIG. 19 after the seal has been set at the pack-off position.

In addition, as shown in FIG. 22, dogs 2800 on the outer surface of upper housing 2252 of outer mandrel 2255 will engage with annular groove 2810 formed on an inner surface of outer housing 2221. This engagement between dogs 2800 and groove 2810 will serve to lock both inner mandrel 2255 and upper mandrel 2250 in position, regardless of fluctuations in the upward pressure $P_2$. One of ordinary skill in the art will appreciate that dogs 2800 are one way of locking the mandrels in position, and that there could be numerous other potential solutions, including locking pins, a hydraulic ram, and others.

To disengage improved well configuration unit 2210, dogs 2800 are disengaged and hydraulic fluid is injected into the lower portion of hydraulic setting cylinder 2220. The hydraulic fluid will exert pressure only on lower surface 2263 of outer housing 2252, thus causing outer mandrel 2250 to move upward and unset the seal formed between seals 2265 and the inner surface of bridge connector 2230 and/or lower spool 2240. Both outer mandrel 2250 and inner mandrel will then continue to move upward within hydraulic setting cylinder 2220 until they reach the initial position shown in FIG. 19.

Although the alternative embodiment shown in FIGS. 19-22 is described in terms of upward and downward forces acting on lower and upper surfaces respectively, one of ordinary skill in the art will appreciate that it is not necessary for the operation of the present invention that the forces act on the upper-most or lower-most surfaces of the inner or outer mandrels.

It is understood that variations may be made in the foregoing without departing from the scope of the present disclosure. In several exemplary embodiments, the elements and teachings of the various illustrative exemplary embodiments may be combined in whole or in part in some or all of the illustrative exemplary embodiments. In addition, one or more of the elements and teachings of the various illustrative exemplary embodiments may be omitted, at least in part, and/or combined, at least in part, with one or more of the other elements and teachings of the various illustrative embodiments.

Any spatial references, such as, for example, "upper," "lower," "above," "below," "between," "bottom," "vertical," "horizontal," "angular," "upwards," "downwards," "side-to-side," "left-to-right," "right-to-left," "top-to-bottom," "bottom-to-top," "top," "bottom," "bottom-up," "top-down," etc., are for the purpose of illustration only and do not limit the specific orientation or location of the structure described above. Similarly, references to the general shape of certain components, such as for example, "planar" or "cylindrical," are for the purpose of illustration only and do not limit the specific configuration of the structure described above.

In several exemplary embodiments, while different steps, processes, and procedures are described as appearing as distinct acts, one or more of the steps, one or more of the processes, and/or one or more of the procedures may also be performed in different orders, simultaneously and/or sequentially. In several exemplary embodiments, the steps, processes, and/or procedures may be merged into one or more steps, processes and/or procedures.

In several exemplary embodiments, one or more of the operational steps in each embodiment may be omitted. Moreover, in some instances, some features of the present disclosure may be employed without a corresponding use of the other features. Moreover, one or more of the above-described embodiments and/or variations may be combined in whole or in part with any one or more of the other above-described embodiments and/or variations.

Although several exemplary embodiments have been described in detail above, the embodiments described are exemplary only and are not limiting, and those skilled in the art will readily appreciate that many other modifications, changes and/or substitutions are possible in the exemplary embodiments without materially departing from the novel teachings and advantages of the present disclosure. Accordingly, all such modifications, changes, and/or substitutions are intended to be included within the scope of this disclosure as defined in the following claims. In the claims, any means-plus-function clauses are intended to cover the structures described herein as performing the recited function and not only structural equivalents, but also equivalent structures. Moreover, it is the express intention of the applicant not to invoke 35 U.S.C. § 112, paragraph 6 for any limitations of any of the claims herein, except for those in which the claim expressly uses the word "means" together with an associated function.

The invention claimed is:

1. A method of operating a zipper manifold, comprising the steps of:

installing on a zipper manifold two or more well configuration units, wherein one or more well configuration unit comprises:

a bridge connector header comprising a throughbore and a bore in fluid communication with the throughbore;

a first mandrel comprising, a first surface, an inner chamber, and a second surface;

a second mandrel comprising a first surface and a second surface; and a sealing element adapted to sealingly engage, at a pack-off location, an inner portion of the well configuration unit located below the bore of the bridge connector header;

wherein the well configuration unit is configured such that a first upward force is exerted on the second surface of the second mandrel and a second upward force is exerted on the second surface of the first mandrel; and exerting a first downward force on the first surface of the second mandrel and a second downward force on the first surface of the first mandrel;

wherein the ratio of the first downward force to the first upward force is greater than the ratio of the second downward force to the second upward force.

2. The method of claim 1, wherein:

the well configuration unit further comprises one or more hydraulic setting cylinders configured to axially move the first mandrel through the throughbore to position the first mandrel and sealing element at the pack-off location; and the method further comprises the step of injecting hydraulic fluid into the hydraulic setting cylinder at a pressure resulting in the first downward force and second downward force.

3. The method of claim 2, wherein the hydraulic setting cylinder is electronically controlled.

4. The method of claim 2, wherein the hydraulic setting cylinder comprises a mandrel lock that is configured to accept a lock pin.

5. The method of claim 4, wherein the lock pin is actuated by a hydraulic cylinder.

6. The method of claim 4, wherein the lock pin is electronically actuated.

7. The method of claim 4, wherein the lock pin is pneumatically actuated.

8. The method of claim 1, wherein at least a portion of the second surface of the second mandrel is substantially concave.

9. The method of claim 2, wherein the second mandrel further comprises a mandrel stop configured to engage the hydraulic setting cylinder when the sealing element has been axially positioned at the pack-off location.

10. The method of claim 2, wherein the hydraulic setting cylinder further comprises a mandrel stop configured to engage the second mandrel when the sealing element has been axially positioned at the pack-off location.

11. The method of claim 1, further comprising the step of causing one or more locking dogs to engage one or more grooves when the sealing element is at the pack-off location.

12. The method of claim 1, wherein the second surface of the first mandrel is configured to engage the sealing element.

13. The method of claim 12, further comprising the step of causing the second surface of the first mandrel to engage the sealing element, such that the sealing element extrudes outwardly in the direction of the inner portion of the well configuration unit.

* * * * *